US005115601A

United States Patent [19]

Yamaguchi et al.

[11] Patent Number: 5,115,601

[45] Date of Patent: May 26, 1992

[54] MOVABLE SKY LIGHT

[75] Inventors: Kenji Yamaguchi; Kenji Hosoyama; Fumitoshi Okazaki; Daisuke Hozumi, all of Tokyo, Japan

[73] Assignee: Sanwa Shutter Corporation, Tokyo, Japan

[21] Appl. No.: 440,044

[22] Filed: Nov. 21, 1989

[30] Foreign Application Priority Data

| | | | |
|---|---|---|---|
| Dec. 21, 1988 | [JP] | Japan | 63-165160[U] |
| Dec. 27, 1988 | [JP] | Japan | 63-168781[U] |
| Dec. 27, 1988 | [JP] | Japan | 63-168782[U] |
| Jun. 20, 1989 | [JP] | Japan | 1-71873[U] |
| Jul. 31, 1989 | [JP] | Japan | 1-90257[U] |

[51] Int. Cl.[5] ..... E04D 13/035; E05F 15/20

[52] U.S. Cl. ..... 52/1; 52/72; 49/21; 454/199

[58] Field of Search ..... 52/1, 200, 62; 49/21; 98/2.01

[56] References Cited

U.S. PATENT DOCUMENTS

| | | | |
|---|---|---|---|
| 2,748,687 | 6/1956 | Ballard | 98/2.01 |
| 4,296,578 | 10/1981 | Keckman | 52/200 |
| 4,365,615 | 12/1982 | Melvin . | |
| 4,416,094 | 11/1983 | Bugener | 52/72 |
| 4,505,069 | 3/1985 | Freeman | 52/200 X |
| 4,570,393 | 2/1986 | Minter | 52/72 |
| 4,570,394 | 2/1986 | Jentoft | 52/72 |
| 4,616,451 | 10/1986 | Glick | 52/72 X |
| 4,726,156 | 2/1988 | Cousino | 52/200 X |
| 4,837,986 | 6/1989 | Gagne | 51/1 |

FOREIGN PATENT DOCUMENTS

| | | |
|---|---|---|
| 187200 | 6/1900 | Fed. Rep. of Germany . |
| 269153 | 7/1911 | Fed. Rep. of Germany . |
| 2153729 | 6/1973 | Fed. Rep. of Germany . |
| 2363978 | 7/1975 | Fed. Rep. of Germany . |
| 2599072 | 5/1987 | France . |
| 446115 | 3/1918 | Switzerland . |

*Primary Examiner*—John E. Murtagh

*Attorney, Agent, or Firm*—Ladas & Parry

[57] ABSTRACT

The present invention presents a movable sky light assembly used on a opening of a roof comprising a fixed frame, a wing frame with a lighting member supported on the fixed frame, said fixed frame being equipped with a driving device to operate said wing frame capable of opening and closing by connecting members for the frames. The fixed frame is provided with a detecting device for rainfall and the detecting device comprises a detecting sensor and its protecting means, and the sky light is constructed so as, when the wing frame is open, the detecting sensor of the detecting device is in the working posture and, when the wing frame is closed, the detecting sensor is protected by the protecting means. As the sky light is used also for ventilation, the connecting members of the frames are formed as a operating member of the wing frame and various aspects of the rain detecting device to close the wing frame in the rain is disclosed in relation to the operating member. Also in the invention, the fixing construction of the lighting member on the wing frame as well as the means for stable operation is improved in many ways to eliminate drawbacks of prior art through the actual experiences obtained. Various combinations are available for the product of the sky light including device for eventual manual operations.

26 Claims, 20 Drawing Sheets

MOVABLE SKY LIGHT

FIELD OF THE INVENTION

The present invention relates to a sky light assembly installed or to be installed on a roof, and more specifically to a movably sky light as a product comprising a fixed frame and a wing frame capable of lighting as well as ventilating.

PRIOR ART

Conventionally, a sky light assembly installed on a part of a sloping roof or a flat roof to take in an effective top light and constructed to be able to ventilate a space under it as a movable sky light (also referred simply to "a sky light" hereinunder) is well known. As known in FIG. 1, such a sky light 1 is used on opening c or on a raised frame around the opening c of roof b of a building a, and comprises a fixed frame 2 and a wing frame 3 connected by connecting members 4 to be able to open and close the wing frame 3. The ways to assemble these frames are to use conventional hinges as connecting members on their corresponding sides to swing the frame 3 up and down, or, as shown in the drawing, to use operating members 40 on opposite sides of the opening c as the connecting members 4 to raise and lower the wing frame 3, or to use the operating members in a pair of link members formed in a shape of parallelogram to act as operating arms to open the wing frame 3 entirely along side of the opening c.

As an example of a movable sky light of a type of-up-and down system, FIG. 1 through 5 is explained.

the sky light 1 comprises a fixed frame 2, a wing frame 3 above the fixed frame 2 and a pair of connecting members 4. The fixed frame 2 is supported and fixed on the structures around the opening c provided on a roof b and the connecting members 4 are disposed on the inside of frame members 21 in the direction of slope of the roof b of the fixed frame 2 and connect the fixed frame 2 and the wing frame 3, forming a pair of operating members 40 for the opening of the wing frame 3. The operating members 40 are driven by a driving device 5 disposed in the fixed frame 2 to operate the wing frame 3 up and down for opening and closing the sky light 1.

As the movable sky light 1 is usually installed in a high position in a building a, the driving device 5 is constructed as an electrical driving device 50, and as shown clearly in FIG. 4, the device comprises an electric motor 51, a main shaft 52 and a set of bevel boxes 53 disposed at both ends of the shaft 51.

The motor 51 is supported by means of bracket 23 fixed on a frame member 22 of the fixed frame 2 located at the upstream of slope of the roof b, and the main shaft 52 is rotatably supported on the bracket 23 and another bracket 24. The output o the motor 51 is transmitted to the bevel boxes 53 by engagement of a gear 54 on a motor shaft and a gear 55 on the main shaft 52 and by means of joints 56, and then, to converted into the revolution of a transmission device 6 located in parallel to the frame member 21.

The transmission device 6 on each side comprises a screw rod 61 and a sliding nut 62 engaged with the rod. The screw rod 61 is connected to the bevel box 53 on its near end through the joint 56 and is supported on a bracket 25 on the frame member 21 on its other end. Then, the nut 62 moves along the screw rod 61 by the rotation thereof, and the output of the driving device 50 is transmitted to the operating members 40 for the sky light 1. The operating members 40 is composed, as shown in FIG. 5, in a shape of X with their 2 rod members 41 of same length crossed at their intermediate point 42 of same length rotatably with a pin. The rod member 41 of a fixed side has its lower end 43 pinned on the frame member 21 of the fixed frame 2 and has its upper end 44 pinned on a corresponding frame member 31 of the wing frame 3, while the rod member 41 of a movable side has its lower end 45 connected to the sliding nut 62 and has its upper end 46 engaged slidably with a long hole 32 provided on the corresponding member 31 of the wing frame 3. Accordingly, by the actuation of the operating members 40, the both rod members 41 open and close at their feet to raise and lower the wing frame 3 in parallel to the fixed frame 2. Reference number 40A in the drawings is an auxiliary operating members installed between a remaining fame 26 of the fixed frame 2 and a corresponding frame member 33 of the wing frame 3. The composition of the members 40A is roughly same as the operating members 40 above, but its action being dependent to the operating members 40, the lower end corresponding to the part 45 of the rod member 41 engaged with the sliding nut 62 differs from the construction described above in engaging slidably with the long hole 62A provided on the fixed frame 2, to act as a means of securing a horizontal and stable support of the wing frame 3 in its opening and closing operations.

The sky light described above belongs to public domain through the application of Utility Model No. Showa 62(1987)-100636, in Japan by the present applicant under the title of "Opening and closing device for a window" and can be referred to.

As for the rest of the composition of the sky light 1, the fixed frame 2 actually has its lower part separated to be fixed on the roof b detachable as an auxiliary fame 27 and is provided with a anti-insect screen 28 by a fastener means **27*a*** for the opening c.

The peripheral part 34 of the wing frame 3 is supported on top face 29 of the fixed frame 2 with air-tight means provided at underside thereof.

At the central part of the wing frame 3, sheets of lighting member 7 are provided for the opening c, lower sheet of which is a wired glass 71 and the upper is a top plate 72. For the top plate 72, transparent material of milky while plastic resin of shaped sheet of acrylite for example is used and the sheet is fixed on the top surface 35 of the wing frame 3. The top plate 72 extends beyond the peripheral part 34 and covers the entire sky light 1, and its outer edge 73 bends downward to cover the fixed frame 2. On the inside of the fixed frame 2, ar formed grooves 57 for receiving condensed dew from inside of the opening c, also at the same time, for forming covering members for the operating members 40, the transmission device 6 and the driving device 50. Reference numerals **58*a* and 58*b* are limit switches to regulate the upper and lower position of the wing frame 3 to detect the moving stroke of the sliding nut 62**.

In FIG. 6, another example with a composition similar to the sky light 1 above is shown in a schematic drawing. Here, two rod members 41 and 41' of the operating members 40 differs from each other in the length beyond the crossed position 42', and by this composition, the opening movement of the wing frame 3 makes an angle against the fixed frame 2.

Next in FIG. 7, an example of a sky light 1 with a hinge means as connecting members 4 is shown. In the sky light 1, the fixed frame 2 and wing frame 3 are connected by a hinge 8 at upstream side of the roof b. And in this example, on the central part of the wing frame 3, there is provided with a glass plate 74 directly on the top surface 35 instead of being covered by a top plate.

A sky light described above as a product according to prior art is employed widely, but some of disadvantages are reported. The first is that, when it rains while the sky light is open, it must be closed in haste. It is conceivable to install a detecting system with a rain sensor outside of a building, and by the signal of the sensor to close the sky light. But in that case, even after the sky light is closed, the sensor is left outdoor exposed to the elements, rain can cause problems reducing the durability of the device, particularly, which is the sensor exposed to bad weather and to direct sunbeams, thereby rending shortening the life of the system in that the sensitivity of the sensor deteriorates or in that electric defects occur in the sensor.

The second problem lies in fundamental functions of lighting of a sky light. The glass plate can be broken by unexpected flying or falling objects. In the prior art, removal of the remaining (broken) pieces of glass is not only cumbersome but it is time-wasting to assemble the sky light with so many parts.

The third problem relates also to the fixing construction of the top plate as a top member of the wing frame. In prior art, screws are used for the fixing, deterioration of an exposed packing member for the screw occurs. Further, when the top plate is made of plastic material, being fixed by screws, the plate cannot follow changing of the outdoor temperature and cracks occur around the fixing parts by stress concentration. The cracks cause not only water leakage, but also the necessity of using many parts like screws, washers, nuts and packing materials in an attempt to overcome the cracking problem, which parts require many fixing holes and as much man power to install the sky light.

As the fourth problem, in the case of a movable sky light operable opening and closing on hinges, when ordinary hinges ar not used and four side members of the fixed frame and the wing frame are manufactured by extrusion, the members on the hinged part are provided with engaging members to form a hinge means to engage with each other by inserting one over the other. To prevent relative motion of both of the frames in the axial direction of the hinge means, it is necessary to provide a series of guide pieces at outer face o the fixed frame to contact and guide the inner face of the wing frame smoothly. The guide pieces require not only special manufacturing and assemblying but the pieces are used in repeated contact and non-contact and, moreover, under shearing stress, the pieces suffer wear and tend to weaken.

Further, as the fifth problem, sky lights are usually installed on the roof in quantity, and they must be operated in various local conditions. So, it has been the experience that standard remote operations of electric sky lights are inconvenient for user.

Further, when electric failure occurs by accident, such as a sudden lightening strike, even if the power for detecting device is otherwise available people must cope with the impossibility to operating the driving device to close the sky light when it is open.

Then, it is necessary to operate the sky light manually, and for the more simple systems, a manual operating device is used. But, a manual operating device, such as an ordinary rod with a hook, is not convenient to operate in a hurry. Moreover, it is impossible to provide an anti-insect screen under the sky light and to allow also for manual rod operation. In the case of a sky light of a type operable by a winding and unwinding a wire-rope, manual operation requires heavy labor even more time of winding.

Then, to eliminate the problems and disadvantages of electrically and manually operated sky light of the prior art described above, the present invention is directed to provide a sky light, the first object of which is improve its operation under the raining conditions. In a movable sky light comprising a fixed frame around an opening and a wing frame with lighting member connected to said fixed frame, said fixed frame being equipped with a driving device to operate said wing frame capable of opening and closing; the fixed frame is provided with a detecting device for rainfall and the detecting device comprises a detecting sensor and its protecting means, and, when the wing frame is open, the detecting sensor of the detecting device is in the working posture and, when the wing frame is closed, the detecting sensor is protected by the protecting means. The invention discloses various type of embodiments such as opening and closing mechanism of operation of connecting members and as protecting means for the detecting device.

The other object of the present invention lies in improvement of supporting and fixing constructions of a lighting member on the upper part of the wing frame in a sky light described above and in similar improvement of construction of the top plate on the wing frame to obtain durability and workability.

Further object of the present invention is, not limited to an electrical sky light, to present a movable sky light provided with a means for manually operable means or a simplar manual sky light to enable local operation for a set of many sky lights as well as capable of corresponding to possible power failures.

DISCLOSURE OF THE INVENTION

The basic idea of the present invention is, in a movable sky light comprising a fixed frame around an opening and a wing fame with lighting member connected to said fixed frame, said fixed frame being equipped with a driving device to operate said wing frame capable of opening and closing; the fixed frame is provided with a detecting device for rainfall and the detecting device comprises a detecting sensor and its protecting means, and, when the wing frame is open, the detecting sensor of the detecting device is in working posture and, when the wing frame is closed, the detecting sensor is protected by the protecting means. And by disclosing various examples for the construction above, it is possible to eliminate the drawbacks of the detecting device left outdoor under the rain even after the sky light was closed causing a problem in the durability of the sensor in the device to be exposed to a bad weather and the direct sunbeams rendering short life of the device by deteriorating the sensitivity of the sensor and even resulting in an electric defects in the detecting device.

Next, the second aspect of the present invention provides various constructions for the basic sky light described above, and shows modifications for the connection of the fixed frame and the wing frame and a ways of opening and closing of the wing frame.

In the first of the connection, both of the frames are connected by a pair of connecting members disposed on opposite sides of the frames to form operating members to act to open and close the sky light, and by the cooperation of the operating members and the driving device, opening and closing of the wing frame are accomplished and the driving device of either electric or manual type can be operated by the output from the detecting device. The operating members raise or lower the wing frame parallel to the fixed frame, or with an angle against the fixed frame, by the link action of a pair of operating rods crossed in X at the central portion.

In the second form of the connection, the fixed frame and the wing frame are connected by a hinge means at their corresponding sides and between these frames an operating member is disposed connecting the frames at its both ends. The operating member is engaged with a driving device to operate the wing frame up and down.

In the third aspect according to the present invention, the lighting material on the top of the wing frame is selected from the transparent materials such as a sheet of glass, pair glass or plastics or the combinations thereof and said pair glass is formed in an anti-moisture glass and when they are fixed in the central portion of the wing frame, outer edge thereof are supported on stepped franges of the wing frame with an adhesive strip capable of sticking on both sides underneath the sheet and upon the seat.

Further, when the lighting member for the wing frame is formed into an anti-moisture glass of double layer, the inner and the outer glass have different sizes to leave a extra stepped zone of the outer glass around the edge of the inner glass and the jointing and sealing parts around the inner glass are disposed apart from the sealing parts around the edges of the outer glass on the stepped seat where the glass is supported.

In the fourth aspect according to the present invention, when a lighting member fixed on the top of the wing frame is a top plate made of plastics, the plate is supported on the top surface of the wing frame while an adhesive strip capable of sticking on both sides is disposed between the top plate and the top surface of the wing frame.

Further in the fifth aspect according to the present invention, when the wing frame operates on a hinge means, at both ends of the hinge means, a guide pieces are installed for the up and down motion of the wing frame. By the movement of inner face of the wing frame along the outer end of said guide pieces, the wing fame can operate without sliding in an axial direction of the hinge means to move up and down.

Still further in the sixth aspect of the present invention, when the wing frame operates on a hinge means, the operating members such as gas-dampers are biased in a direction to open the wing frame, and the sky light is provided with a driving device composed of manual operating device acting on the opening side.

In the disclosures of the invention, an actual embodiment of an operating device is illustrated.

The device comprises a main shaft supported on the fixed frame, an operation shaft supported on the wing frame, lock members fixed on the main shaft and a belt means engaged with both of the shafts by a winding drum fixed on the main shaft. The lock members are capable of engaging with the operation shaft to hold it while the wing frame is closed and release the operating shaft when the wing frame beings to open through the leaning operation from the lock-releasing member. One end of the belt means is fixed on the winding drum of the main shaft through a biasing spring in the drum in a direction to be wound and on the other end thereof, an engaging ring member for engaging with an manual operation rod of ordinary type with a hook at its end.

Other characteristics of the present invention will be better understood from the following description referring to the attached drawings which show nonlimitative embodiments.

BRIEF DESCRIPTION OF THE DRAWINGS

FIG. 1 is a general perspective view of a sky light;

FIG. 2 is a vertical cross-sectional view along the line II—II in FIG. 1;

FIG. 3 is a vertical cross-sectional view along the line III—III in FIG. 1;

FIG. 4 is a plan view of the sky light;

FIG. 5 illustrates operation of opening and closing of the same;

FIG. 6 illustrates operation of a sky light of another example;

FIG. 7 is a vertical cross-sectional view of further example similar to FIG. 2;

FIG. 8 is a general perspective view of a sky light corresponding to FIG. 1;

FIG. 11 is a detailed plan view of the device;

FIG. 12 is a detailed plan view of the device;

FIG. 13 is a perspective view of a cleaning device of the detecting device;

FIG. 14 is a perspective view of the second embodiment of the detecting device;

FIG. 15 illustrates the operation of the same;

FIG. 16 through 18 schematically illustrate the third embodiment of the detecting device;

FIG. 19 is a side view of the fourth embodiment of the device;

FIG. 20 through 22 illustrate various examples of prior art in the fixing construction of lighting member to a wing frame of a sky light;

FIG. 23 is a detailed cross-sectional view of fixing part of lighting member of the present;

FIG. 24 is its enlarged detail;

FIG. 25 illustrates an adhesive strip;

FIG. 26 through 29 illustrate fixing construction when the lighting member is a pair glass;

FIG. 26 is a perspective view of a wing frame;

FIG. 27 and 28 illustrate examples of fixing construction of the lighting member of prior art;

FIG. 29 is a cross-sectional view of fixing construction according to the present invention;

FIG. 30 is a detailed drawing of fixing part of a top plate to a wing frame in prior art;

FIG. 32 is a vertical cross-sectional view in a direction in right angle corresponding to FIG. 7;

FIG. 33 is a plan view at the corner of a fixed frame of a sky light;

FIG. 34 is an exploded perspective view at an end of a hinge means showing a guide piece;

FIG. 35 is a vertical cross-sectional view of a sky light similar to FIG. 7;

FIG. 36 is a vertical cross-sectional view in right angle to the FIG. 35;

FIG. 37 is a side view of a locking member for a manual operation device;

FIG. 38 is an underside perspective view of a wing frame when it is open;

FIG. 39 is a perspective view of the locking member when it locks the wing frame;

FIG. 40 is a perspective view of the locking member when it releases the wing frame;

FIG. 41 and 42 illustrate the closing operation of the locking member;

BEST MODE OF CARRYING OUT THE INVENTION

Figure 8:
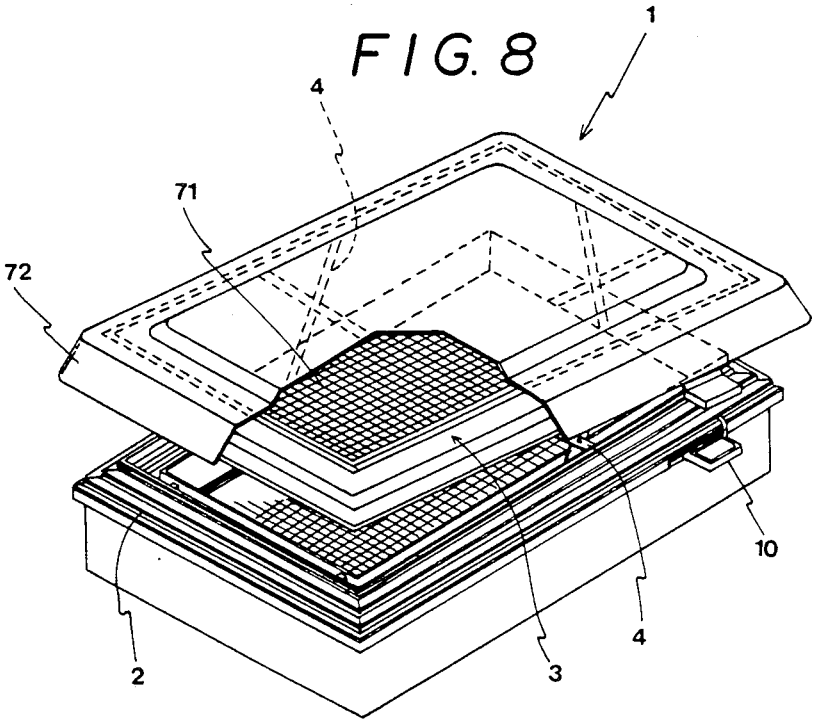
FIG. 8 and the followings illustrate basically a sky light according to the present invention.
Figure 9:
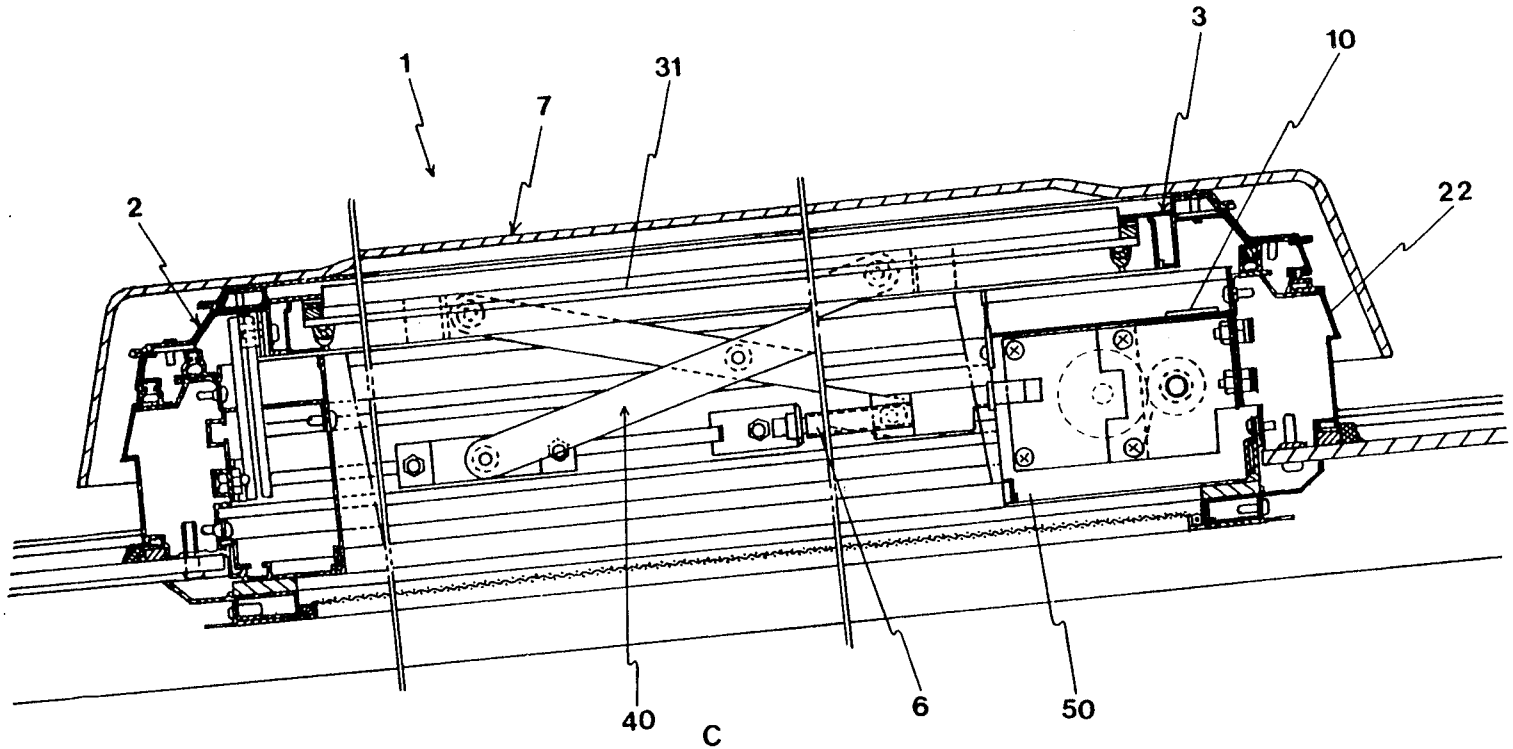
FIG. 9 is a vertical cross-sectional view similar to FIG. 2.
Figure 10:
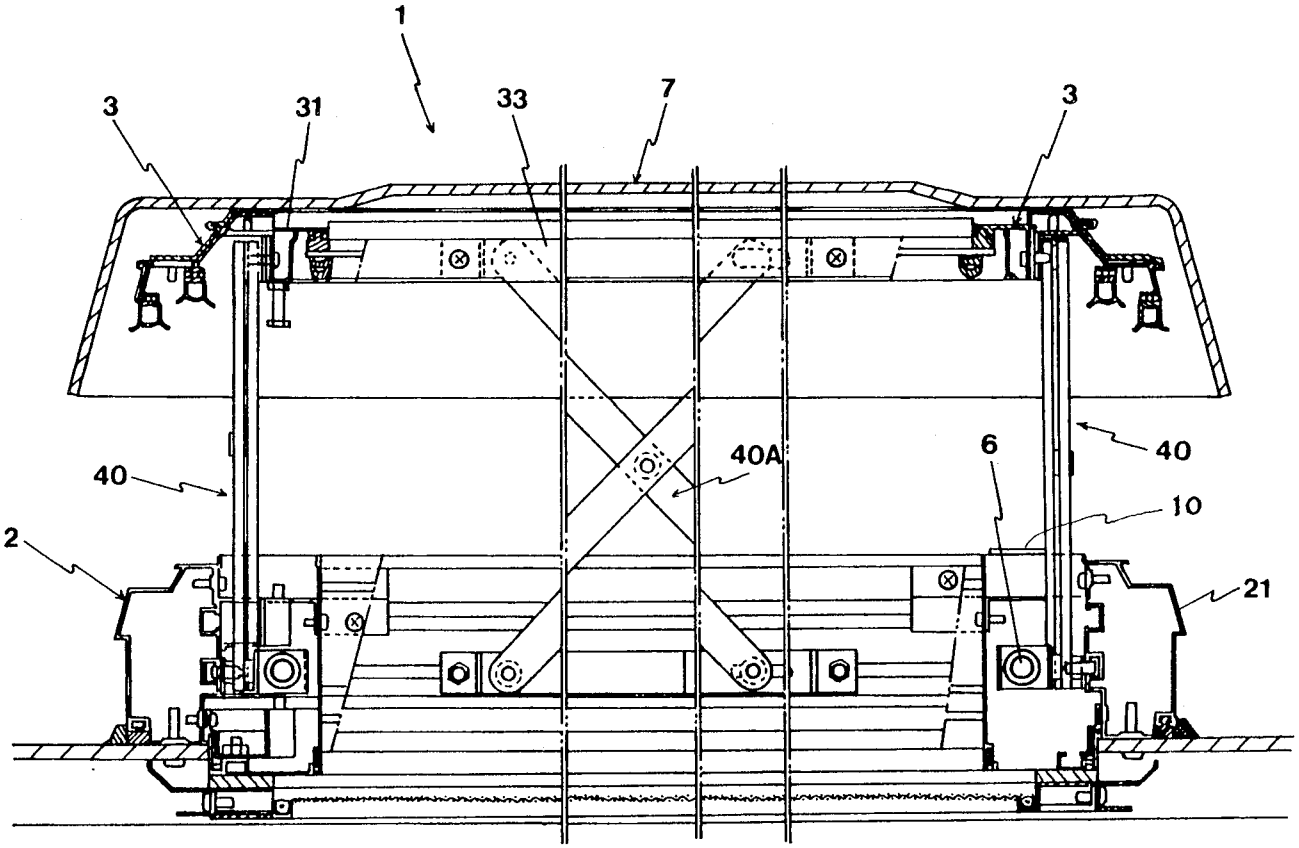
FIG. 10 is a vertical cross-sectional view similar to FIG. 3.
Figure 11:
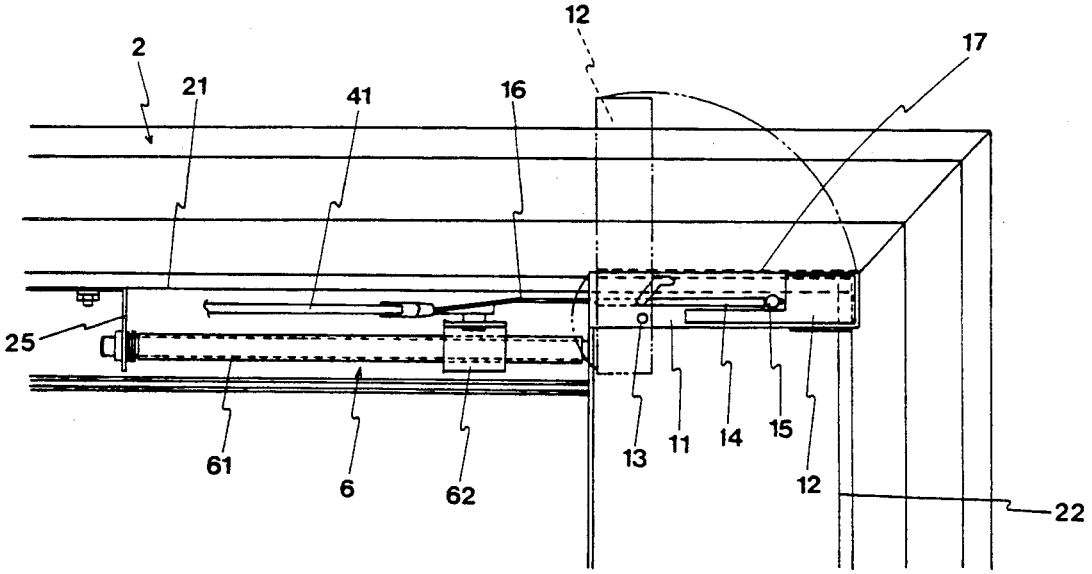
FIG. 11 through FIG. 19 illustrate a detecting device for rainfall.
Figure 12:
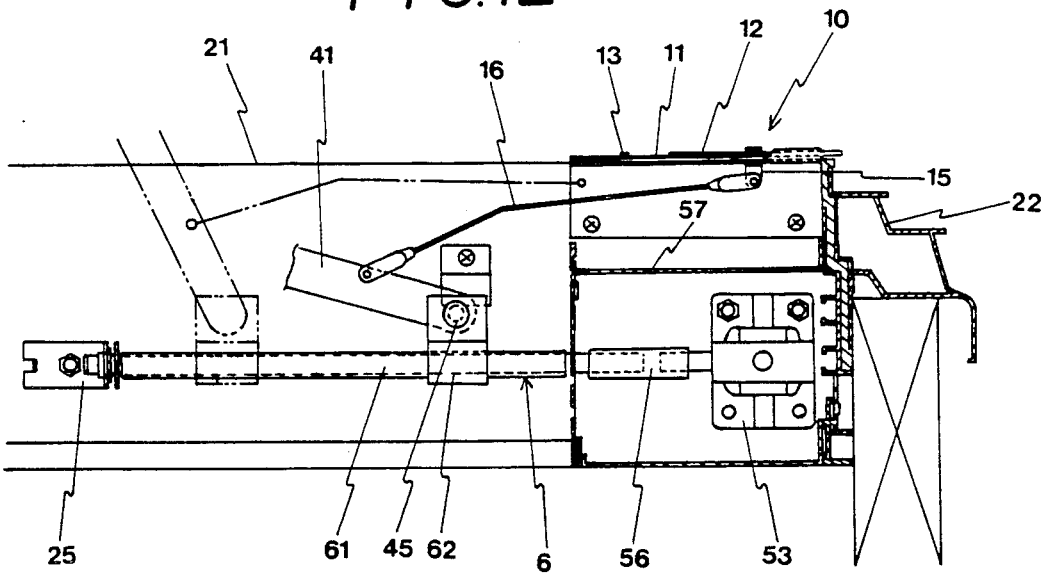

The movable sky light assembly according to the present invention will be described in detail with reference to the attached drawings of a preferred embodiment. Reference numerals in FIG. 1 through 7 are adopted in common to corresponding parts in the following. FIG. 8 through 10 correspond to FIG. 1 to 3 and each shows a detecting device 10 for rainfall added at the corner of the fixed frame 2 of the basic construction of the sky light described before. The detecting device 10 comprises, as shown in FIG. 11 and 12, a base body 11, and a detecting sensor 12 for rainfall disposed on top of the base body 11, and the base body 11 is supported pivot tally by a pin 13 at its base end onto an end part of frame member 22 near the frame member 21 of the fixed frame 2. In longitudinal direction of the base body 11, a long hole 14 is provided and a sliding piece 15 is engaged slidably. On the lower end of the sliding piece 15, one end of acting rod 16 is pinned. The acting rod 16 is formed in a shape of "dog leg" and the other end is pinned on an end pat 45 of one of rod members 41 of the operating members 40 with its lower end 45 connected to the sliding nut 62 of the transmission device 6 to transmit the action of the rod member 41 to the sliding piece 15.

Figure 13:
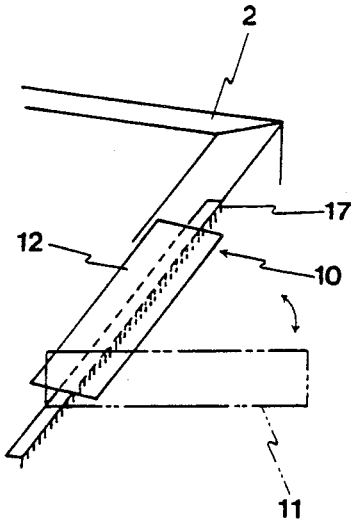

In FIG. 13, a perspective view to illustrate swinging motions of the detecting device 10 is shown. At an upper part of the fixed frame 2, a long hole equipped with a brush 17 for the cleaning of the detecting device is provided. When the base body 11 passes swung in and out under a brush the top surface of the detecting sensor 12 on the base body 11 is cleaned by the brush 17 to keep its sensitivity.

Figure 14:
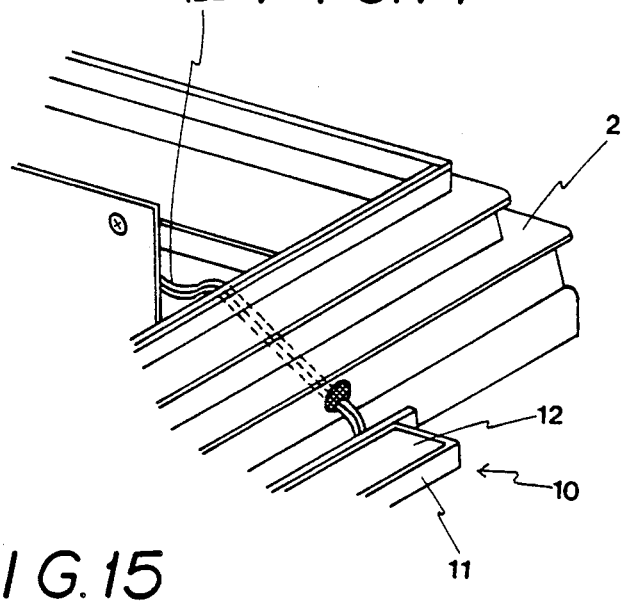
Figure 15:
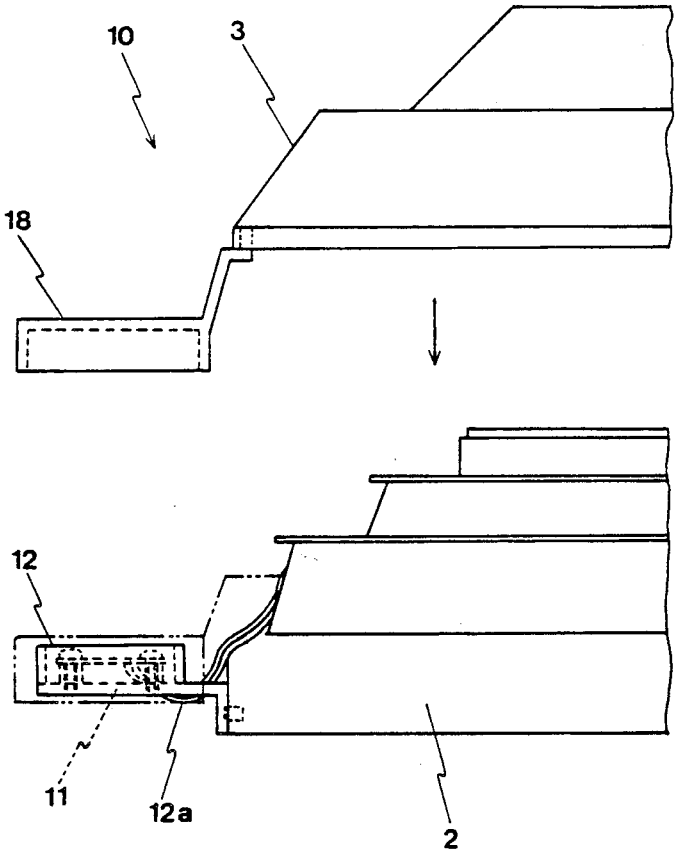

In FIG. 14 and 15, the second embodiment of the detecting device is shown. The device 10, as shown also in FIG. 8, is disposed on the fixed frame 2 to have its base body 11 projecting outward, and directly above it, a cover body 18 projecting from and supported on the wing frame 3 is provided. Accordingly, when the wing frame 3 closes, the detecting device 10, projecting outward, comes under the protection of the cover body 18. The numeral 12*a* shows an electrical wiring for the detecting sensor 12 connected to a controller of the driving device 50 not shown.

Figure 16:
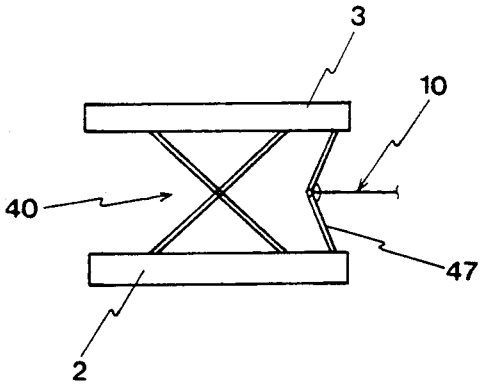
Figure 17:
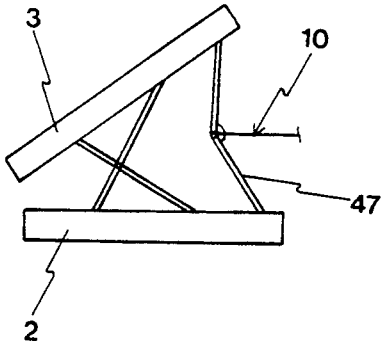
Figure 18:
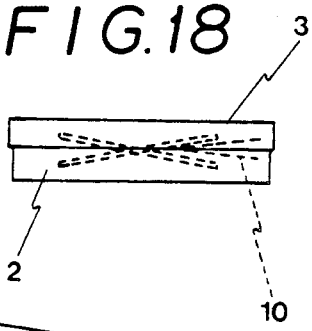

In FIG. 16, outline of the third embodiment is shown. In this case, besides the operation members 40 connecting the fixed frame 2 and the wing frame 3, a foldable link member 47 to follow the operation of the operating members 40 is provided and at the bending part of the link 47, a detecting device 10 is equipped projecting outward. The example shown in FIG. 17 corresponds to the sky light shown in FIG. 6 and, in both of the examples, when the detecting device 10 works and closes the sky light 12, device 10 becomes contained and protected in the fixed frame 2, as shown in FIG. 18.

Figure 19:
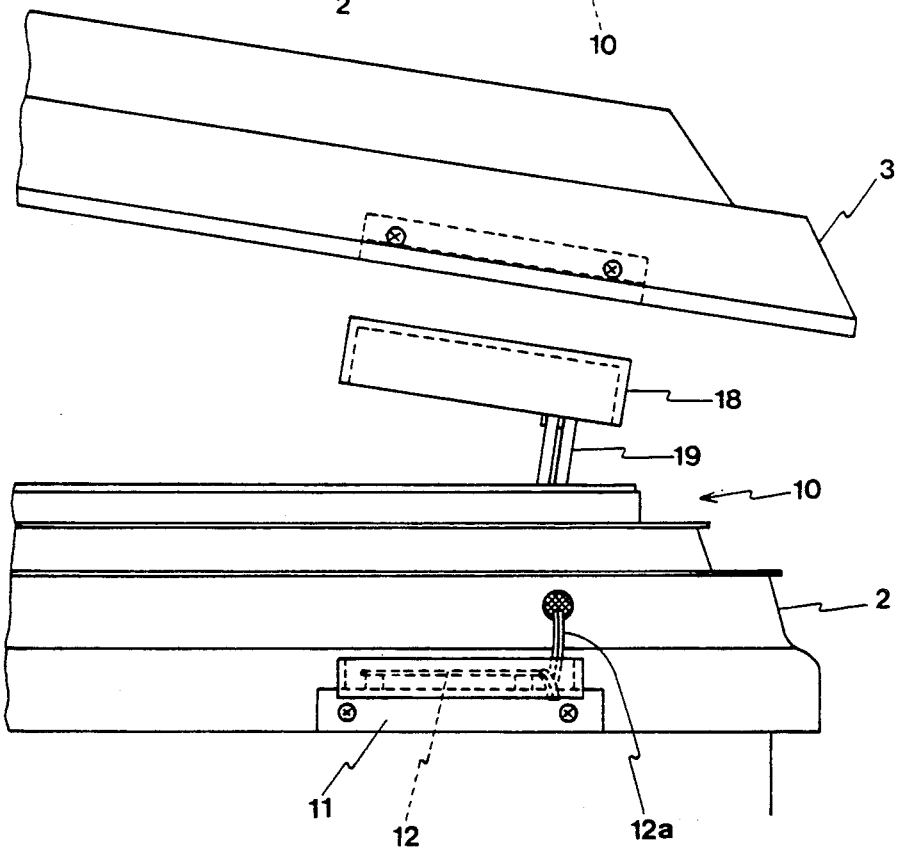

Further in FIG. 19, a fourth embodiment is shown. In this case, the detecting device 10 is fixed on the fixed frame 2 like the second case, and a cove body 18 is provided like the second case to protect the detecting device 10 when the wing frame 3 closes. But in this instant, the cover body 18 is fixed on top of a cylinder 29 attached to the fixed frame 2, and it locates the cover body 18 directly above the detecting device 10. The cylinder 19 is biased in the direction to extend itself, and is composed so as to raise the cover body 19 following an opening motion of the wing frame 3, and to lower the cover body 18 to cover the device 10 when the wing frame 3 closes.

Figure 20:
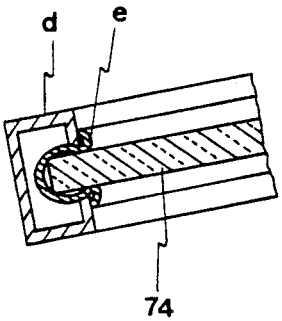
FIG. 20 through 30 illustrate fixing construction of an upper part of a movable sky light.
Figure 21:
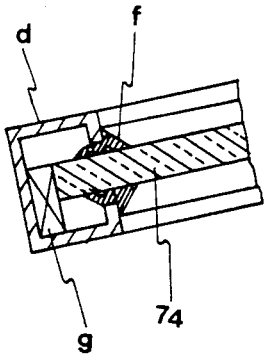

Next, as the third aspect of the invention, the construction of top part of a sky light is explained. In the case of prior art shown in FIG. 7, a glass plate 74 installed in the central part of the wing frame 3 is fixed on the wing frame 3 in a manner shown in FIG. 20 to 22 conventionally. In FIG. 20, a glass plate 74 as a lighting member 7 is fixed on a frame d in a shape of window frame by inserting a glass plate 74 with a grazing channel e provided previously around it. In a case of FIG. 21, a glass plate 74 is fixed by using a beed strip f with the edge of the plate contacting to a glass block g previously provided in the frame d.

Figure 22:
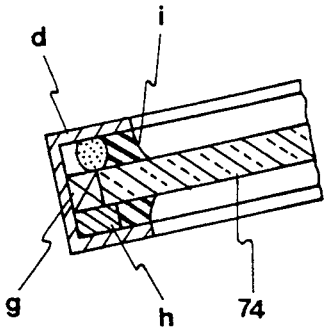

Further in a case of FIG. 22, in the frame d with a cross section of U, a seat plate h is laid and, a glass block g is supported on the seat plate h, then, the glass plate 74 is inserted to be held tightly by filling corking material i.

All these fixing methods follow a conventional grazing technic and reveal the drawbacks mentioned.

Figure 23:
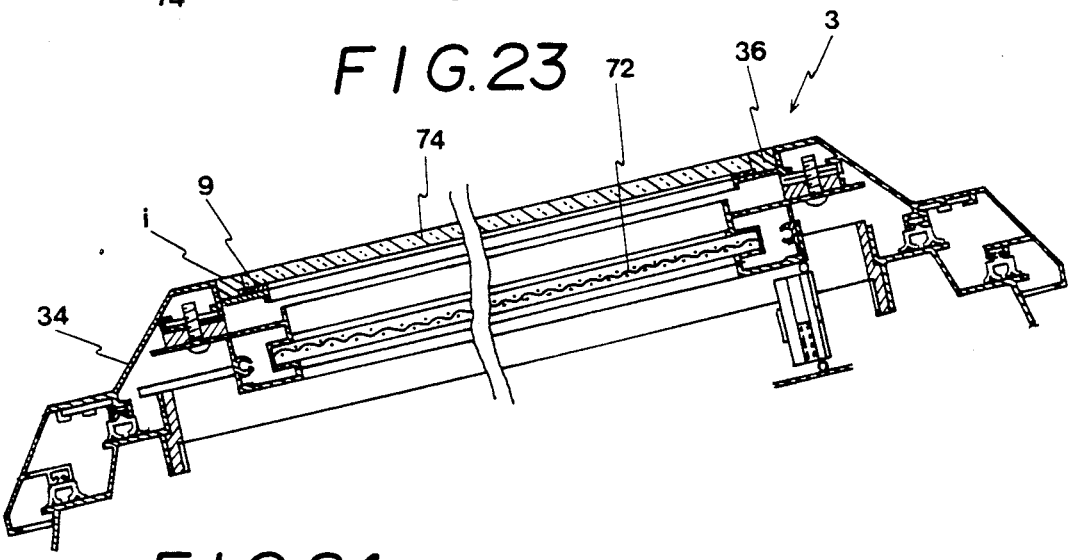
Figure 24:
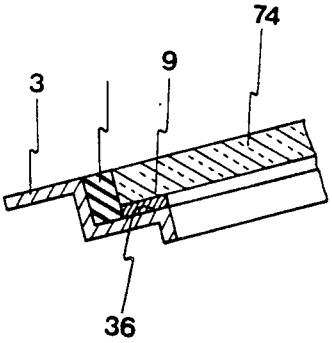
Figure 25:
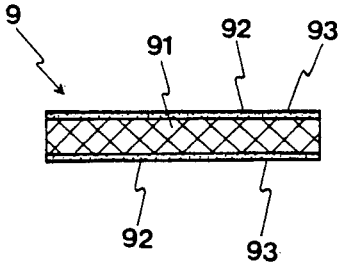

Then, as shown in FIG. 23 through 25, along the inner franges of the wing frame 3, a stepped seat 36 for the glass plate 74 is formed. Here, with one side edge aligned with the edge of the stepped seat 36, an adhesive strip 9 capable of sticking by pressing on both sides is laid upon the surface of the step 36. Then, by pressing the outer edge of the glass plate 74 on the strip 9, the glass plate 74 is supported and sticked on the wing frame 3. As for the adhesive strip, as shown in FIG. 25, a product made as a structural fastening member is used. The adhesive strip 9 is composed of a base strip 91 made of soft material such as polyethlene form, or acryl form, a strong adhesive material 92 from an acril family on both sides of the bas strip 91, and a protecting sheet material pasted peelablly on the adhesives 92. And between the frame member 31 of the wing frame 23 and the edges of the plate glass 74, a corking material i is applied to form double sealing around the glass with the adhesion of the adhesive strip 9. The height of the stepped seat 36 formed by folding is selected so that the sum of thickness of the glass plate 74 plus that of the adhesive strip 9 with consideration of its compressed state to be equal to the height of the top surface 35 or higher.

Figure 28:
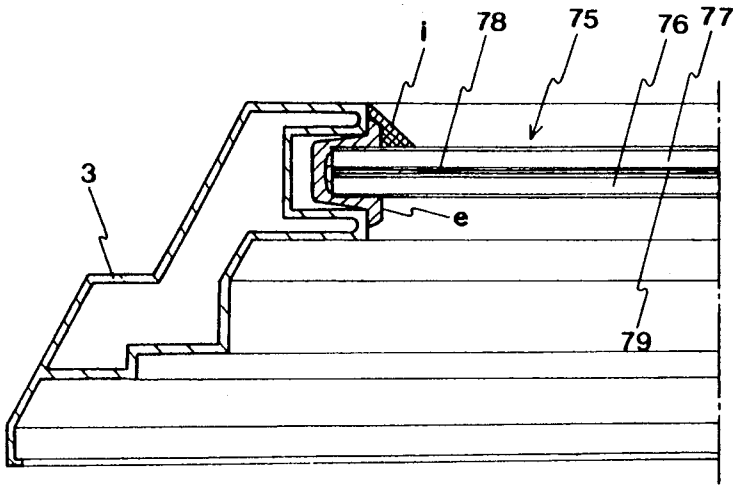
Figure 26:
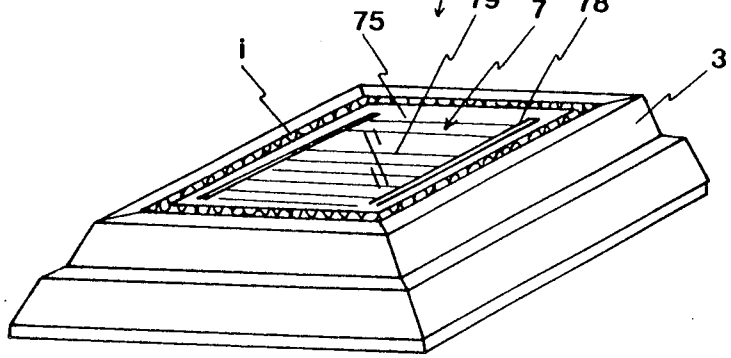
Figure 27:
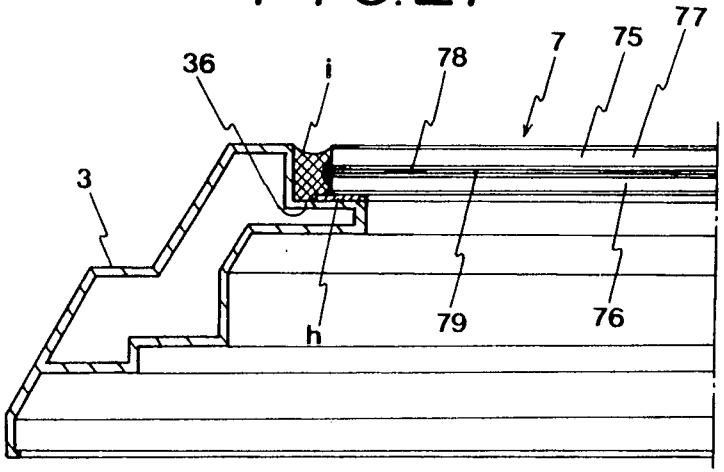

Next, in a sky light shown in FIG. 23, a case when the plate glass 74 as a lighting member 7 is substituted with a pair of glass plates as will be explained. FIG. 26 shows a perspective view of a sky light 1 of such a design. Inside of the wing frame 3, an anti-moisture glass 75 of double layer is fixed. Such a double layer glass is known as a combined pair of glass plates and an electric heater and, as shown in FIG. 27 and 28, is composed of an inner plate 76 and a outer plate 77 with a pole plate 78 and heating wire 79 made of tungsten forming a heater. Here, conventionally, the anti-moisture glass 75 is supported on the stepped seat 36 formed inside of the wing frame 3 with a seat plate h like the previous example, and fixed water-tightly by a corking material i on the edges like FIG. 27, or by holding the glass 75 on the edges by a grazing channel e and corking material i like FIG. 28.

However, the corking material i as a means of water-tightness and the jointing part of the pair glass sticks each other, and the aging deterioration of the corking material i and its cracks are inevitable and causes the influences on the sealing part of the pair glass. Accordingly, not only water leakage occurs but the effect of the anti-moisture glass is attenuated and short circuit occurs on the electric systems as drawbacks of prior art.

In the present invention, the supporting and fixing constructions of the pair glass on the wing frame 3 are improved. In the fixing construction of the present invention, as shown in FIG. 28, the glass 75 is supported on a stepped seat 36 formed on the inside of the wing frame 3. The size of the inner glass 76 is smaller than the outer glass 77 so as to leave an extra stepped zone of the outer glass 77 around the edge of the inner glass 76 and the jointing and sealing parts around the inner glass 76 are disposed apart from the sealing parts around the edges of the outer glass 77 on the stepped surface 36. And it is preferable to us the adhesive strip 9 disclosed in the preceding embodiment.

Figure 30:
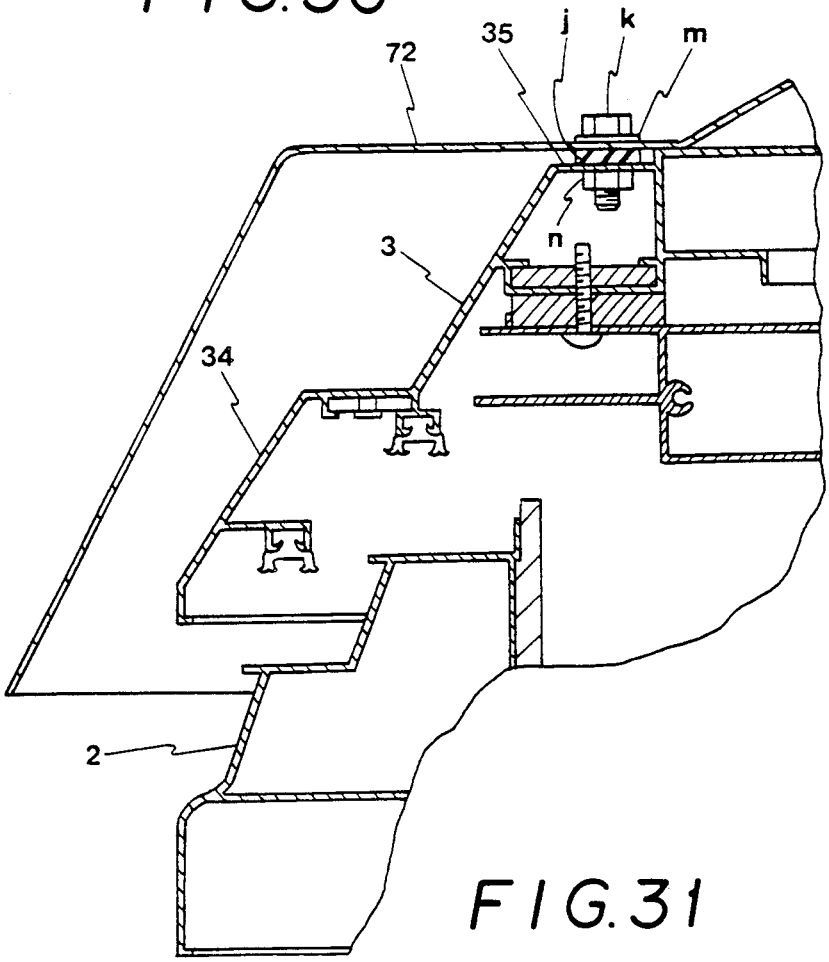

Next, as for the fourth aspect of the present invention, the construction of upper part of a sky light is described as the fixing construction of a top plate 72 on the wing frame 3. On the top of the wing frame 3 of the sky light 1, usually, a top plate 72 made of plastics as an overall roof is used. In the fixing construction of prior art, as shown in FIG. 30, a top plate 72 is supported on the top surface 35 of the wing frame 3 and covers the peripheral part 34 of the wing frame 3 and the fixed frame 2 below. The top plate 72 is made of a plate of semi-transparent plastics such as milky white acryl plate and the top plate 72 is fixed on the wing frame 3 by means of packings j, screws k, washers m and nuts n through common screw holes provided on both parts. But, because of screw k being exposed on its top and deterioration of packing j, good water tight construction is hardly obtained resulting in the leakage of water. Moreover, due to the difference of the temperature of outside and inside of the building a, the top plate 72 made of plastics elongates and contracts, while the behavior is restricted by fixing of screws k unabling to follow the difference, resulting in producing many cracks. Further problem is found in workability of the fixing to use many part materials and they require providing of holes and labors therefor.

Figure 31:
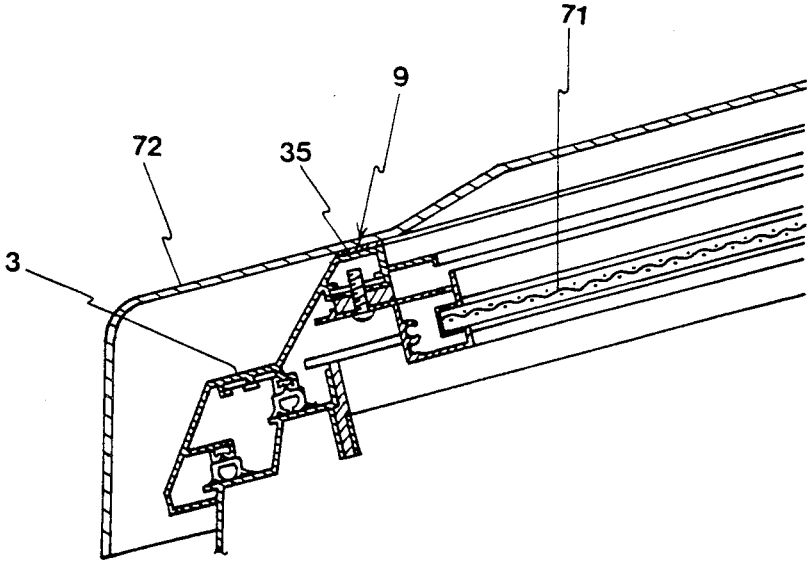
FIG. 31 is a detailed drawing of the same of the present invention.
Figure 32:
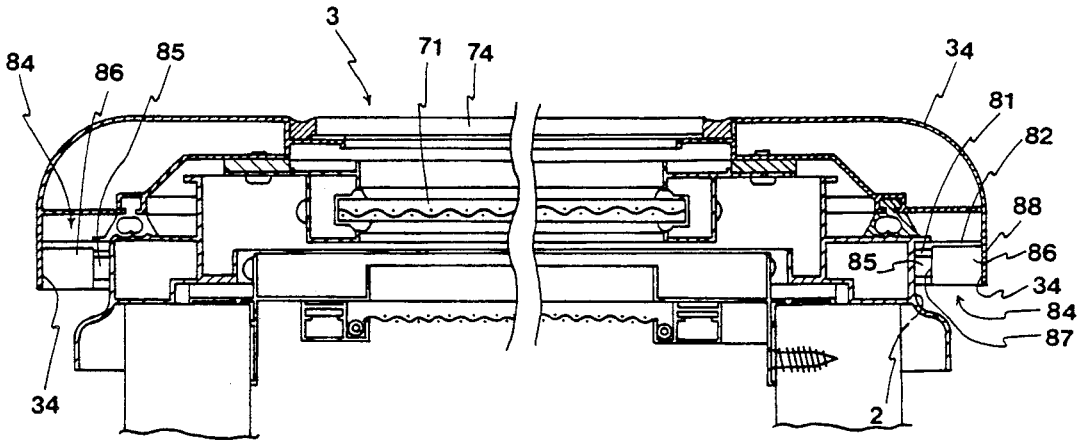
FIG. 32 through 34 illustrate connecting members when they are formed in a hinge.

The present invention is to eliminate these disadvantages by applying a fixing construction of glass plate 74 on the wing frame 3 described above. FIG. 31 shows a cross-sectional view of the wing frame 3 of the present invention. The top plate 72 is supported on the upper face 35 of the wing frame 3 by sticking the under side of the adhesive strip 9 on the surface 35 of the wing frame 3 and then sticking the underside of the top plate 72 directly on top of the adhesive strip 9. By this construction, the top plate 72 is easily fixed on the top surface 35 of the wing frame 3 by using the adhesive strip 9 in an ordinary method only, and without any additional process on the materials used, while, the construction has no parts exposed over the top plate 72 not only rendering no fear of leakage, but the behavior of relative motion of the top plate 72 against the wing fame 3 due to the difference of the temperature or the direct sunbeams are absorbed in sticking layers between them to secure the function of the plate 72 made of plastics as the lighting member 7.

Next, in relation to the connecting construction of the fixed frame 2 and the wing frame 3, the fifth aspect of the present invention is explained referring FIG. 7 and FIG. 32 to 34.

Figure 1:
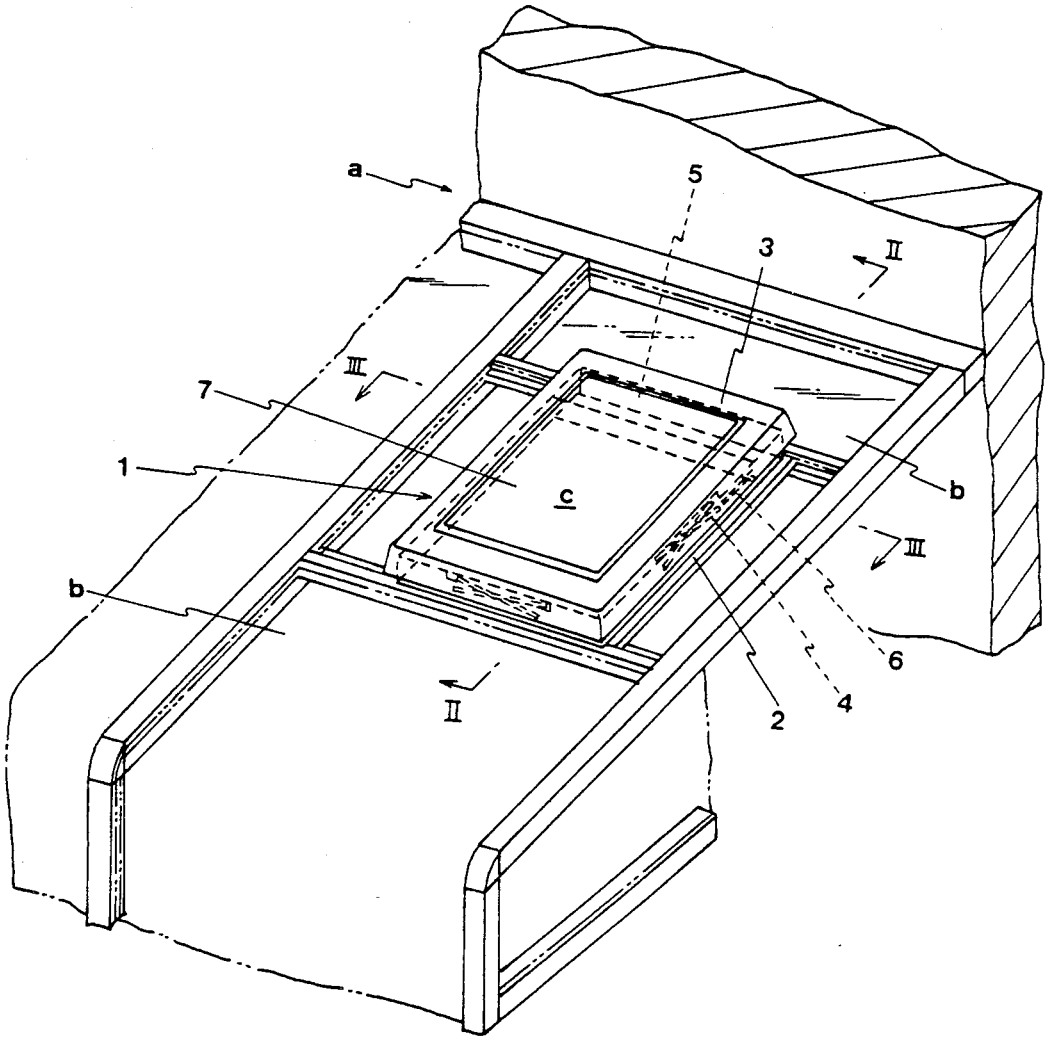
FIG. 1 PRIOR ART
FIG. 1 through FIG. 7 illustrate basic construction of a sky light of prior art.
Figure 2:
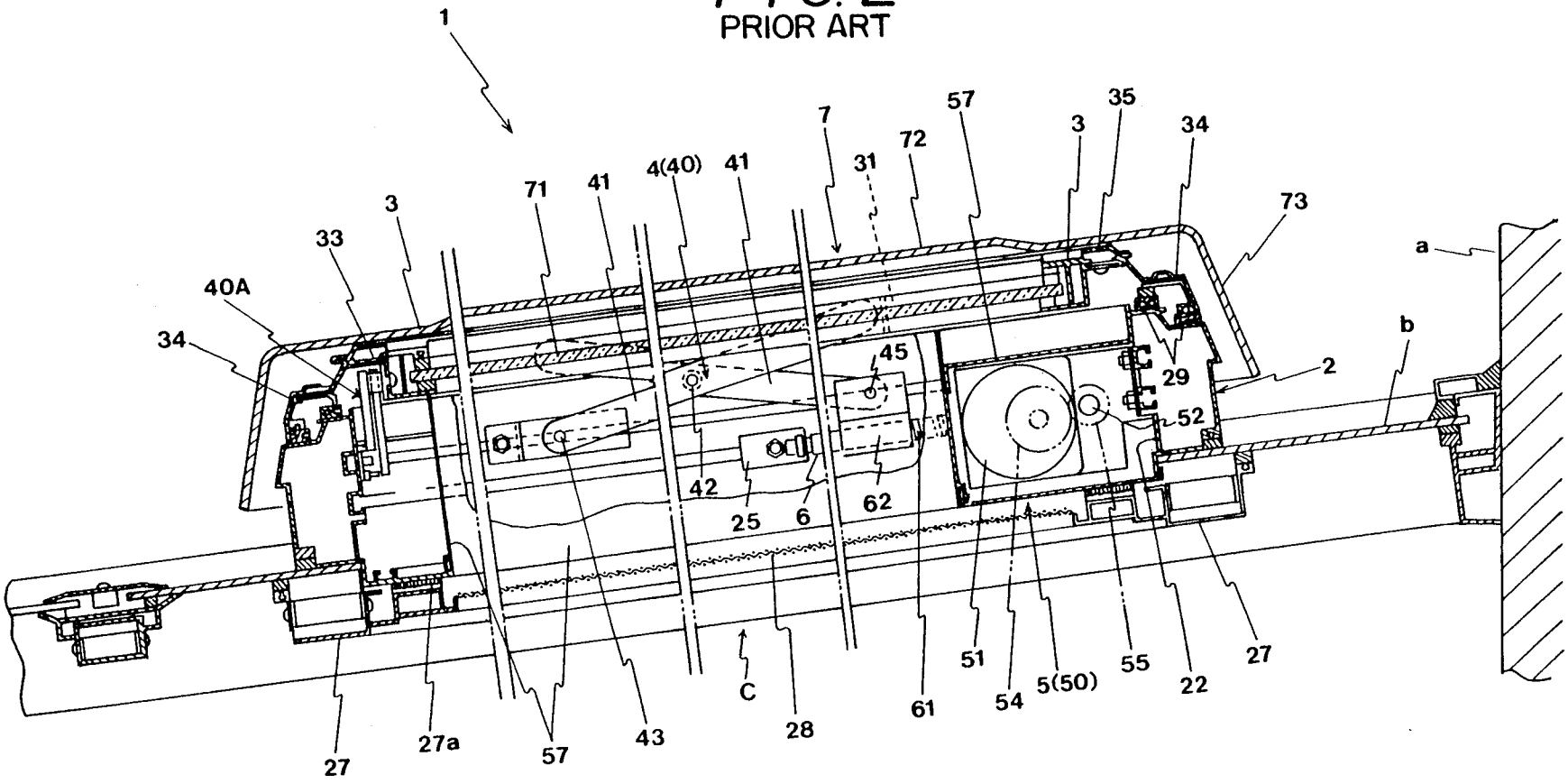
FIG. 2 PRIOR ART
Figure 3:
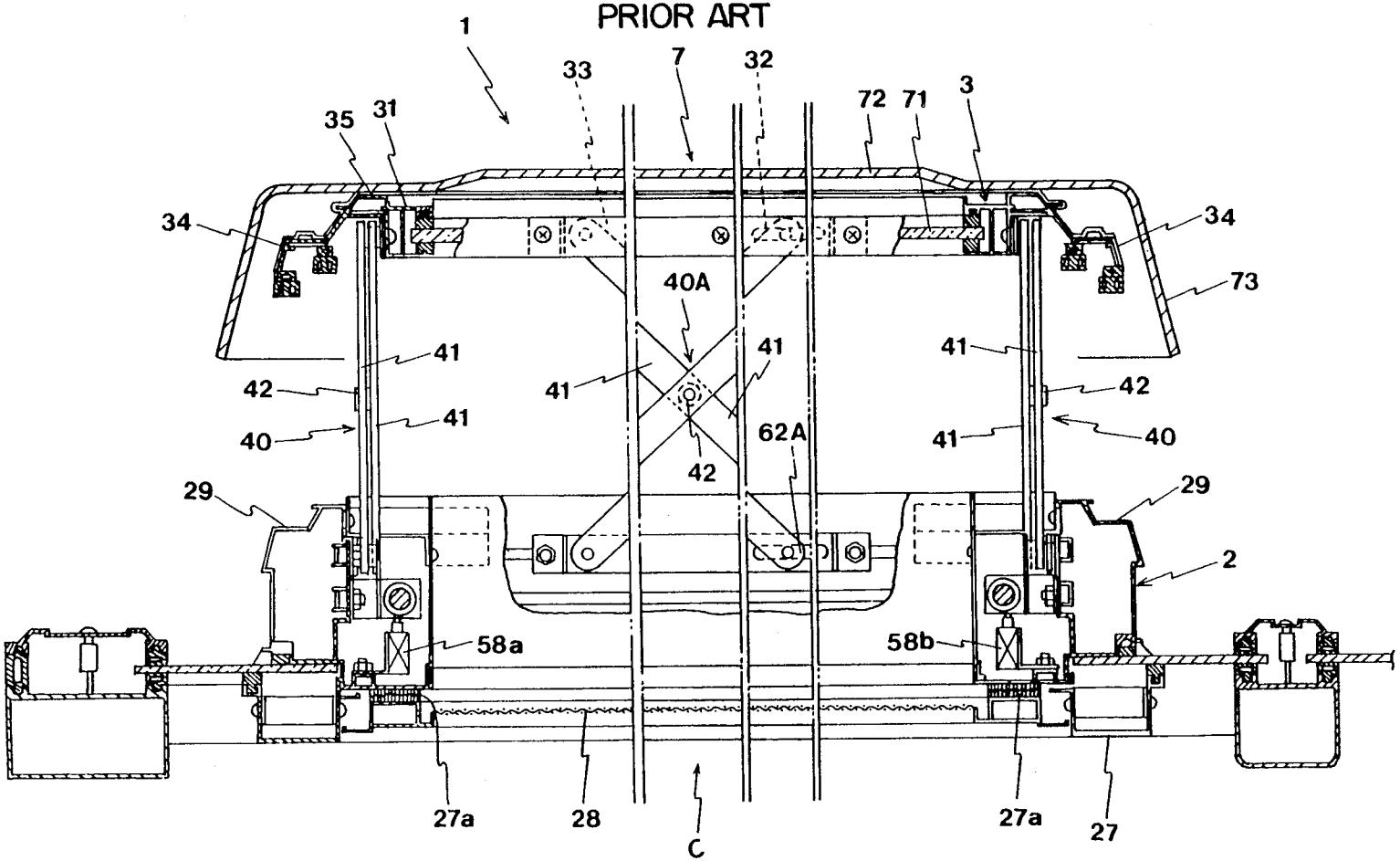
FIG. 3 PRIOR ART
Figure 4:
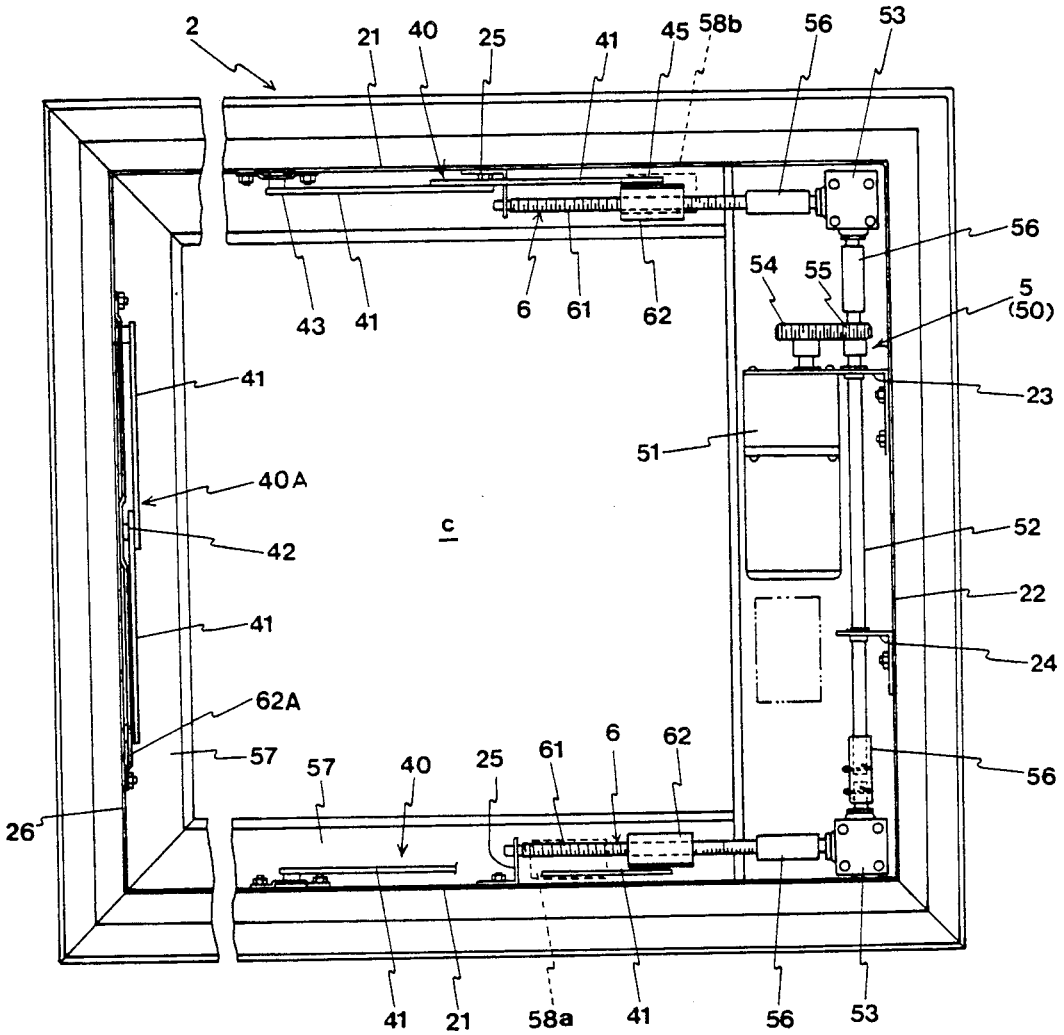
FIG. 4 PRIOR ART
Figure 5:
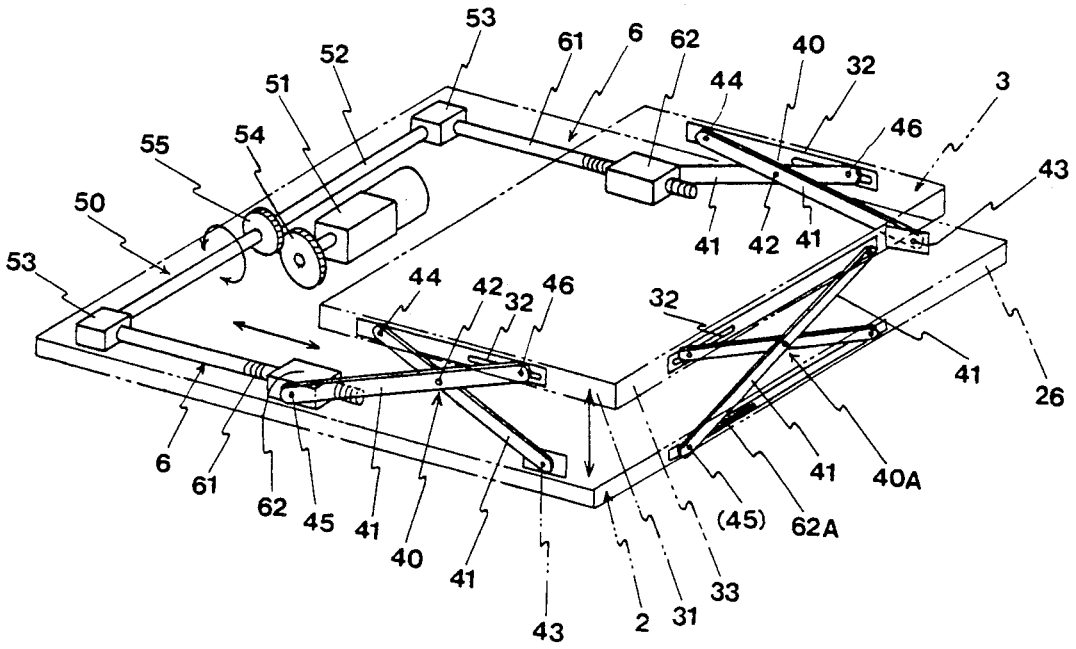
FIG. 5 PRIOR ART
Figure 6:
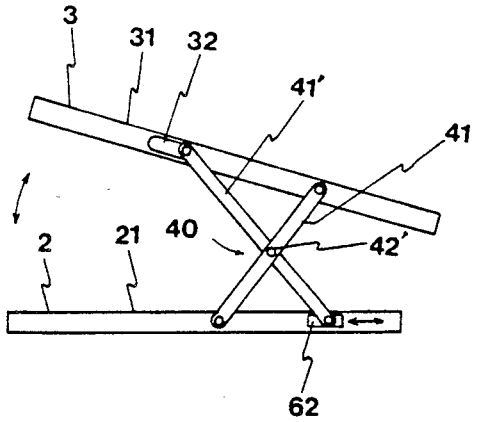
FIG. 6 PRIOR ART
Figure 7:
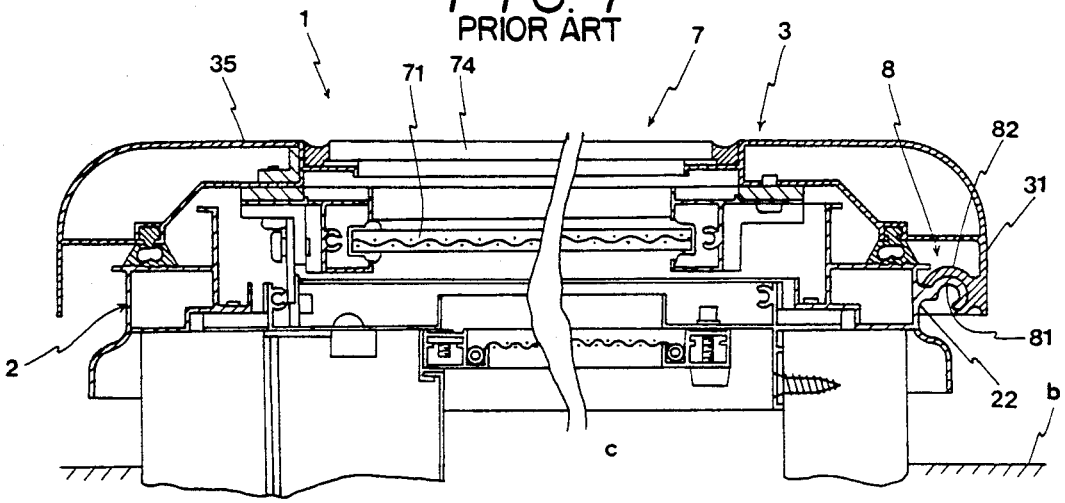
FIG. 7 PRIOR ART

In connecting constructions operable of opening and closing of a sky light 1, applying a hinge means 8 for the fixed frame 2 and the wing frame 3, as shown in FIG. 7, is well known. The hinge means 8 is composed to having engaging members on corresponding sides of both of the fixed frame 2 and wing frame 3 to be engaged with each other. Along the outside of the frame member 22 of the fixed frame 2, an engaging member 81 in a shape of smaller C in section for the fixed side is formed longitudinally in extruding manufacturing, and, similarly, along the inside of the end of the periphery 34 of the wing frame 3, an engaging member 82 with a larger diameter of C is formed to be engaged with the former on its outside is formed. The engagement of these members 81 and 82 is accomplished by inserting the member 81 into the mouth of the C of the engaging member 82 while the wing frame 3 is held wide open over the fixed frame 2.

Figure 33:
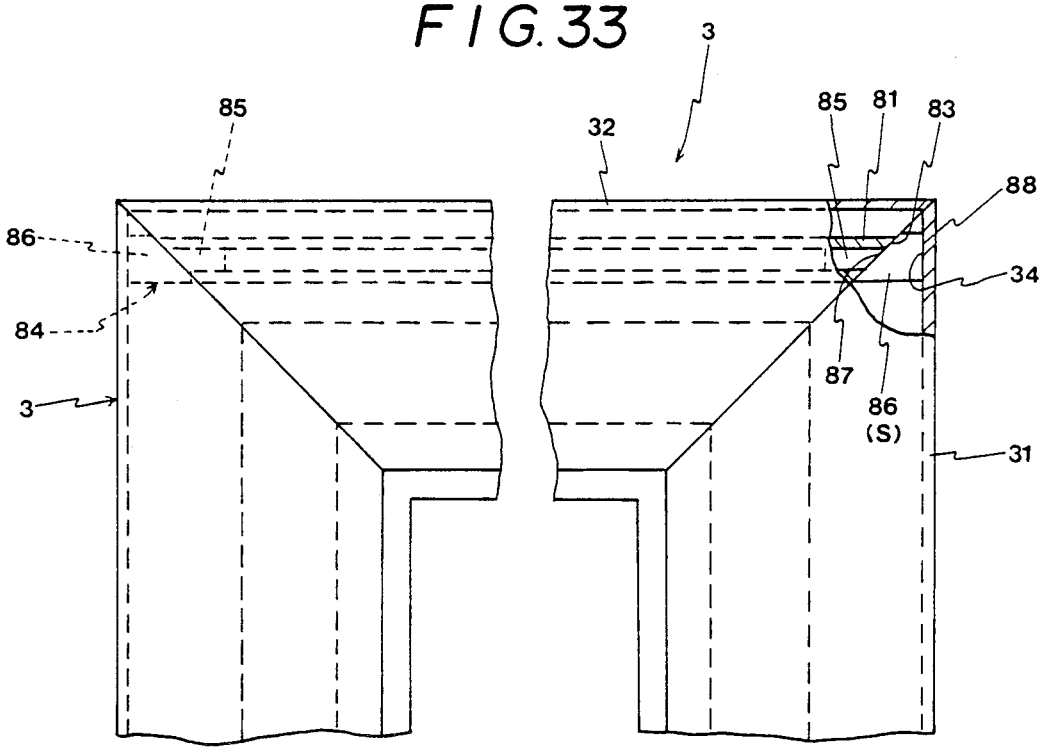

In the meanwhile, in assembling of the wing frame 3, as shown in FIG. 33, each of the frame member 31 and 32 is fabricated with its ends cut diagonally in 45°. Accordingly, the engaging members 81 and 82 of the hinge 8 have a free surfaces 83 at both ends, and between the face 83 and the inner side of the periphery 34 of the wing frame 3, a gap space s are formed. The gap space s means that the engaging members 81 and 82 of the hinge 8 can slide in its longitudinal direction freely, and requires means of preventing the movement. In prior art, a plurality of guiding pieces are provided on outside of the fixed frame protruding in the gap space to contact with a series of the engaging holes provided on the inner face of the wing frame 3 to guide the wing frame 3 step by step and to prevent its axial movements during its opening and closing operation. The resolution not only requires much of manufacturing process and labors but repeated operation to contact and release and a shearing force acting on the guide pieces render disadvantages of its early wearing and deteriorations.

Figure 34:
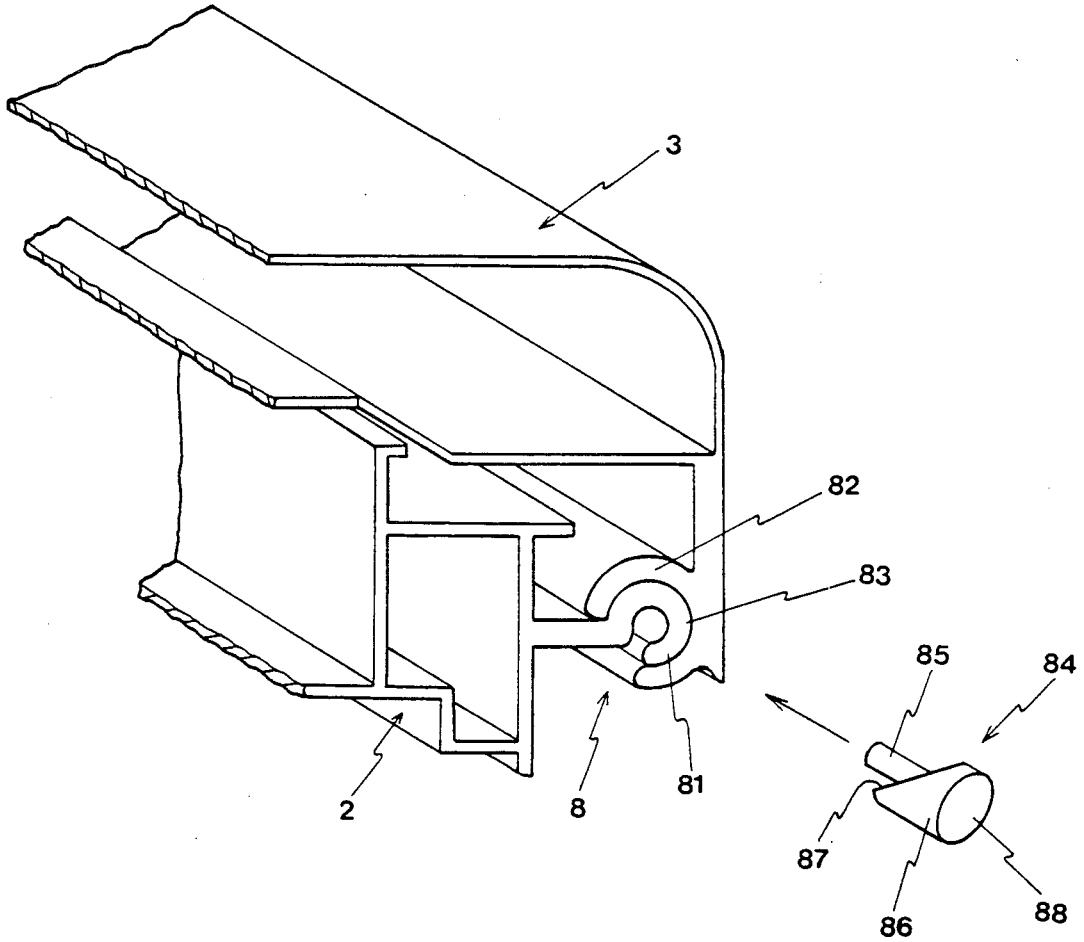

In the present invention, the problems above are resolved basically by providing guide pieces of a new type. As shown in FIG. 34, the guide piece 84 according to the present invention comprises a leg 85 and a head 86, and the leg 85 has a diameter to be inserted into the engaging member 81 of fixing side, while the head 86 has a diameter to match with the engaging member 82. The reducing part from the head 86 to the leg 85 has a diagonal plate 87. The length of the piece 84 corresponds to the gap space s in the state that it is inserted into the hinge 8 and the outer end plane 88 of the piece 84 contacts to the opposing inner face of the wing frame 3 to guide it smoothly while its operation.

Figure 35:
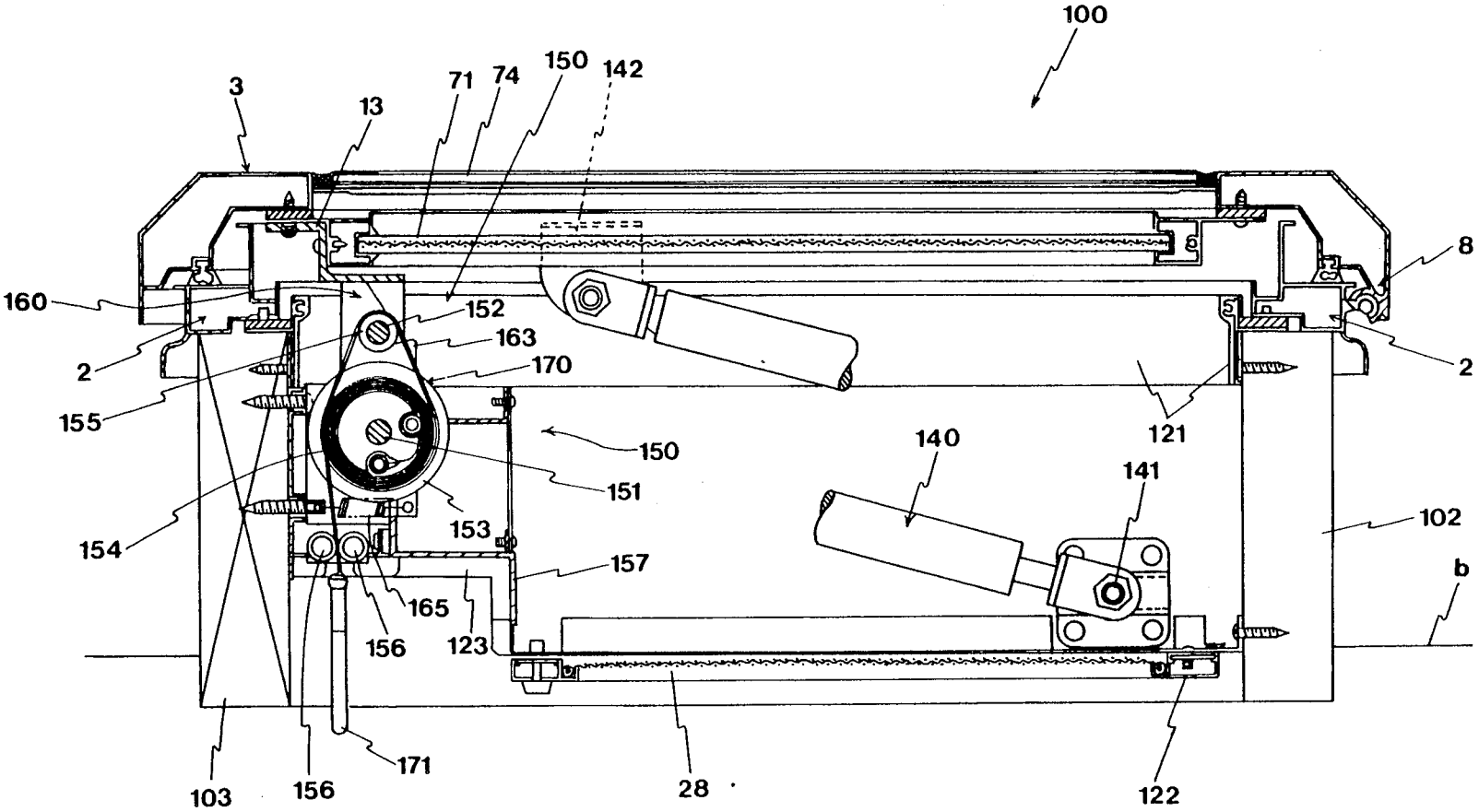
FIG. 35 through 42 illustrate manual operating device for a sky light.
Figure 36:
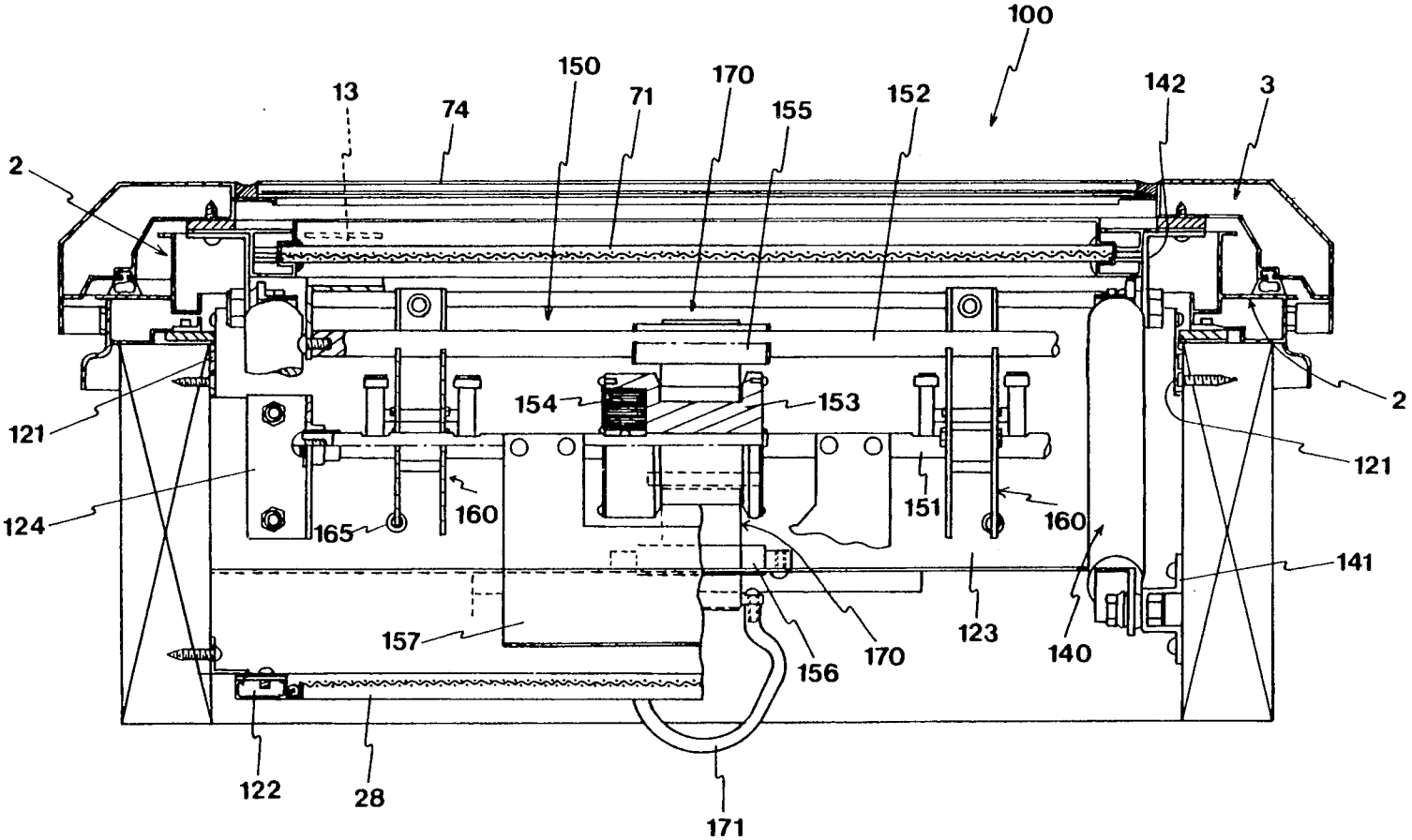
Figure 37:
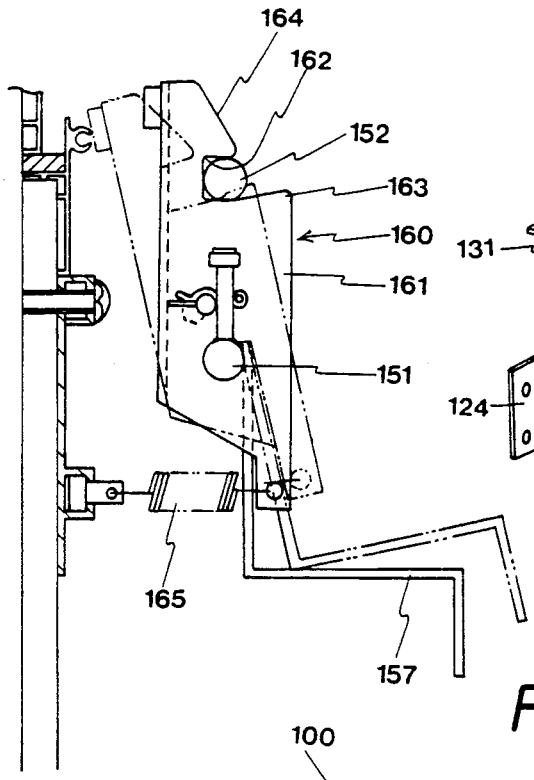
Figure 39:
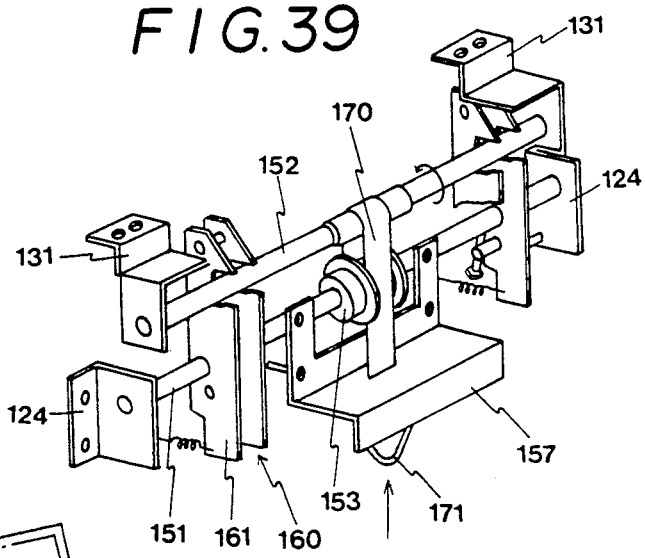

In the sixth aspect of the present invention, the sky light 1 can be, along the fifth object set forth before, equipped with a manual operation device. The operation device is explained referring to FIG. 35 through FIG. 42. FIG. 35 and 36 are vertical cross section of a sky light 100 equipped with an operation device 150 as a manual driving device. Similar to prior art, the fixed frame 2 and the wing frame 3 are connected by the hinge 8 and the details thereof are no longer explained except that, in this case, the sky light 1 is fixed on the raised frame 102 on a roof b and that sub-frame belonging to the fixed frame 2 (former 27) now consists of an upper frame 121 and lower frame 122.

The operation device 150 is installed along a frame 103 opposite to the raised frame 102 with the hinge 8, in a container 123 formed with cover body, and comprises a horizontal main shaft 151 supported on brackets 124 fixed on the frame 103, an operation shaft 152 supported on brackets 131 in parallel to the main shaft 151, a set of lock members 160 fixed on the main shaft 151 and capable of engaging and disengaging with the operation shaft 152 according to the operation of the sky light 100 and an operation belt 170.

Firstly, on the middle part of the main shaft 151, a winding drum 153 is provided rotatably with a coil spring 154 with its one end fixed on the main shaft 151. On the operation shaft 152, at the corresponding part above the winding drum 153, a roller 155 is fixed, and around the drum 153 and the roller 155, the operation belt 170 is wound. One end of the belt 170 is connected to the outer end of the coil spring 154 and one the other end of it, an ring member 171 is fixed. Where the operation belt 170 passes through the bottom of the cover of the container 123, a pair of guide rollers 156 are provided to prevent the ring member 171 from being drawn into the inside of the container 123 and secures the ring member 171 to remain capable of receiving a hook on a operation rod of an ordinary type (not shown).

In the front of the rollers 156, fixed on the main shaft 151 at its top edge, a lock-releasing member 157 made of a folded plate is provided. Except its working space, under the container 123, a screen 28 is spanned on the sub-frame 122.

Next, the lock member 160 formed with its main body 161 shaped in a form of U in horizontal section, is fixed on the main shaft 151 through its franges. At an upper part of the main body 161, level with the height of the operation shaft 152 when the wing frame 3 is closed, a notch 162 to receive and engage with the operation shaft 152 152 is formed, while on the jaw part of the notch 162, a projection 163 is formed. Above the notch 162, a tapered edge 164 is shaped on the main body 161 to guide the operation shaft 152 while closing. And at a lower part of the main body 161, between the side frame 103, a contracting spring 165 is provided to hold the lock member 160 is upright and in engaging position with the operation shaft 152 in the notch 162 to keep the wing frame 3 in closed position as shown.

For the operation members 40 in the sky light 100, corresponding to the hinge means 8 as connecting members 4, usually, an operation member of a type capable of actions for extension and contraction, and supported on a pin to be operable of tilting is used.

Figure 38:
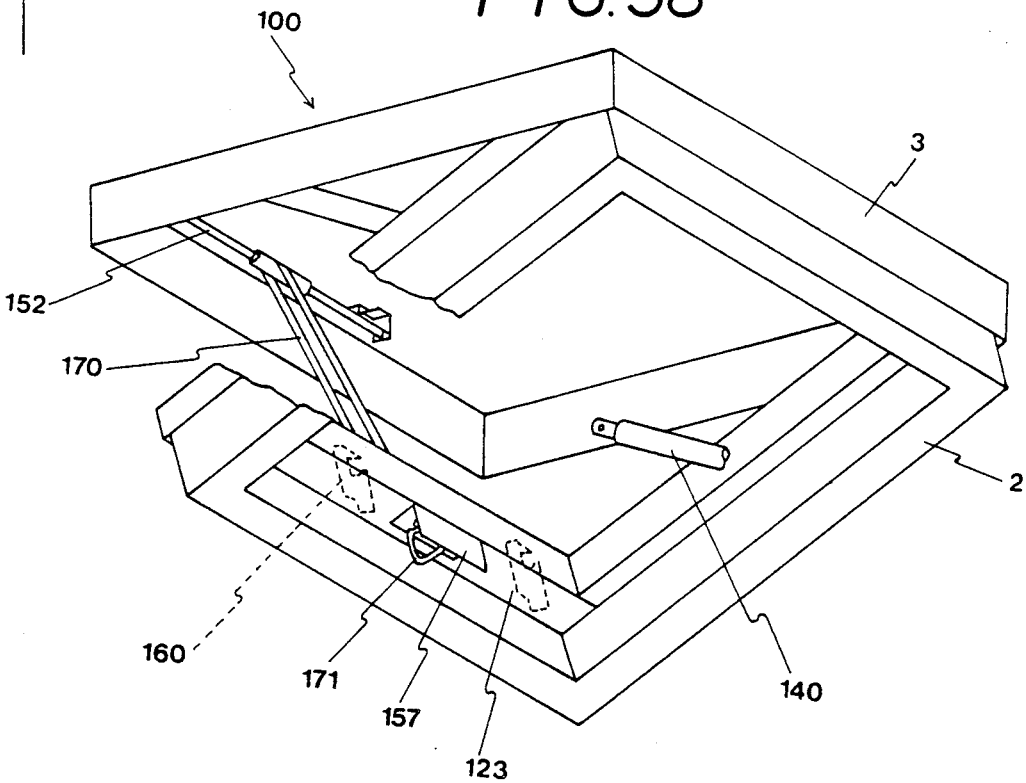

In the embodiment shown in the drawing, a gas-damper 140 is adopted as an operation member and the gas-damper 140 is installed between the sub-frame 122 and the wing frame 3 with its base end 141 pinned on the former and the other end 142 on the latter to bias the swing frame 3 in the opening direction. Accordingly, in a state shown in FIG. 35 and 36, the operating shaft 152 is engaged with and held in the notch 162 of the lock member 160 against the biasing force of the gas-damper 140, and when the lock-releasing member 157 is pushed upward to tilt the lock member 160 in a state of 2-dotted line in FIG. 37, to release the operation shaft 152, the wing frame 3 on which the shaft 152 is supported opens as shown in FIG. 38 by the biasing force of the gas-damper 140.

It is noted that the sky light of the present invention is not, of course, restricted to the embodiments explained above, but can be modified within the spirits of the invention. Especially, in the manner whether the connecting members 4 of the fixed frame 2 and the wing frame 3 are composed directly to be the operation members, or equipped with other operation members beside the hinge means as connecting members, belong to the consideration of the selection of design.

OPERATION

The operation of the movable sky light according to the present invention is explained referring to the utilization and operating method of the sky light.

When the movable sky light 1 is used, at first, to raise the wing fame 3 for the ventilation by the driving of the driving device 5, as shown in FIG. 12, by the revolution of the screw rod 61 of the transmission device 6, the sliding nut 62 moves to the position shown in a 2-dotted line in FIG. 12 to stand up the rod member 41 of the acting side and following the rising of the wing frame 3, the acting rod 16 moves along the long hole 14, while the base body 11 swings outward of the fixed frame 2 and the detecting sensor 12 on the base body 11 come to the position exposed to the heaven to detect rainfall. Here, when raindrops fall on the sensor 12, the sensor gets on to send its output signal to the control device of the electric motor 51 and the motor 51 turns in reverse direction to close the wing frame 3. Accordingly, by the lying motion of the rod members 41, the base body 11 returns in reverse way to its original position and entire detecting device 10 including the sensor 12 is contained inside the fixed frame 2.

On this occasion, as shown in FIG. 13, while the base body 11 of the detecting device 10 passes under the brush 17 provided in the fixed frame 2, the top face of the sensor 12 disposed thereon is wiped and the sensor 12 keeps always its cleanliness to secure its sensitivity.

As shown in FIG. 8, FIG. 14, 15 and FIG. 19, in the second and fourth embodiment, the base body 11 of the detecting device 10 never swings out and in, but in each case, the detecting device 10 is installed on the fixed frame 2. When the wing frame 3 is open, the detecting sensor 12 is exposed in the position to work, and when the wing frame 3 is closed, the device is protected by the cover body 18 disposed directly above the detecting sensor 12. Therefore, when it rains rather diagonally to enter into the opening c, distance between the cover body 18 and the sensor 12 secures raindrop to reach to the sensor 12 to be detected.

In the third embodiment, as shown in FIG. 16, due to the action of the foldable link member 47, the detecting principle of protecting the sensor 12 when the wing frame 3 is closed is clearly understood in a same way to be contained in the fixed frame 2.

Next, in the construction of the upper part of the movable sky light of the present invention, the fixing construction shown in FIG. 23 through 25 is adopted, where on the folded stepped seat 36 provided on the wing frame 3, an adhesive strip 9 capable of sticking on both side is laid and then by pressing the glass plate 74 on the strip 9, and, with corking material i filled between the frame member 31 of the wing frame 3 and the glass plate 74 all around the glass 74, double sealing of water-tightness formed by the corking i and the adhesive strip 9 is obtained.

Figure 29:
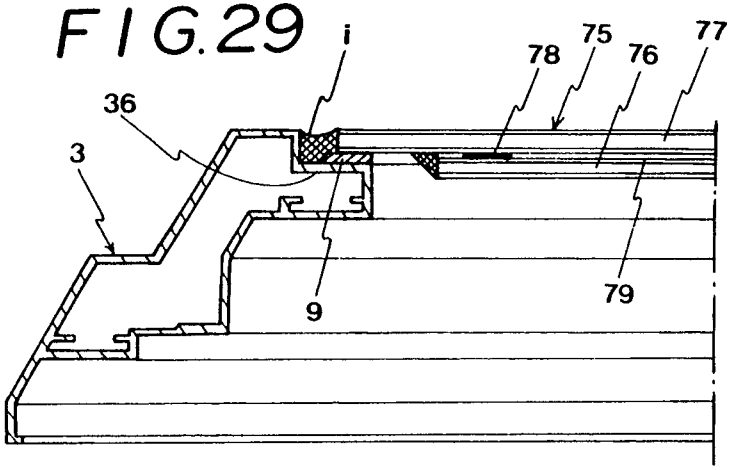

Next, when the glass plate 74 as the lighting material 7 is changed, as shown in FIG. 26, to an anti-moisture glass 75 of double layer, as shown in FIG. 29, an stepped seat 36 is formed on the inner periphery of the wing frame 3, and the anti-moisture glass 75 is supported thereon.

The size of the inner glass 76 is smaller than the outer glass 77 so as to leave an extra stepped zone of the outer glass 77 around the edge of the inner glass 76 and the jointing and sealing parts around the inner glass 76 are disposed apart from the supporting and sealing parts around the edges of the outer glass 77, enabling its support on the stepped surface 36 by the outer glass 77 only, free from any influences of the deterioration and cracks of the sealing material i.

Moreover, when the adhesive strip 9 disclosed in the preceding embodiment is used, the sealing construction is not only considerably simplified but its fixing function is also improved.

In the fixing construction of the top plate 72 at the topmost part of the sky light 1 of the present invention, as shown in FIG. 31, the top plate 72 is easily fixed on the top surface 35 of the wing frame 3 by a method to use the adhesive strip 9 as an only material, without any process on the top plate itself. In the construction, the fixing parts used are never exposed outside of the top plate to render not only the water leakage, but, even if the top plate 72 has a behavior of elongation and contraction due to the difference of the outdoor temperature or to the direct sunbeams, the relative motion between the wing frame 3 can be absorbed at the adhesive layers and the characteristics of the top plate made of plastic sheet as the lighting material 7 is secured intact.

Next, as shown in FIG. 35 through 42, the guide pieces 84 to be disposed on the end surface 83 of each engaging members 81 and 82 of the hinge 8 are first fixed by their leg 85 inserted into the engaging member 81 of fixed side and then the diagonal surface 87 at the reducing of the head 86 is contacted to the diagonal end plane 83 of the hinge member 81.

Here, with the end plate 88 of the head 86 kept perpendicular to the axial line of the hinge 8, the wing frame 3 is lifted to a wide angle, and the engaging member 82 of movable side is fitted over the engaging member 81 through its opening. That makes the hinge complete and locates the guide piece 84 for the wing frame 3 at the end plane 83 of the hinge 8 and the end plane 88 of the head 86 is kept contacting with the inner side of the periphery 34 of the wing frame 3 during the operation thereof without relative movement in the axial direction of the hinge 8 in a stable and smooth operations.

In the meanwhile, as described above, the sky light 1 often requires local operations and closing operations are also needed during possible power failure. Then, in the present invention, besides the electrical driving device, a sky light 100 installed with a manual operating device 150 is presented.

Figure 40:
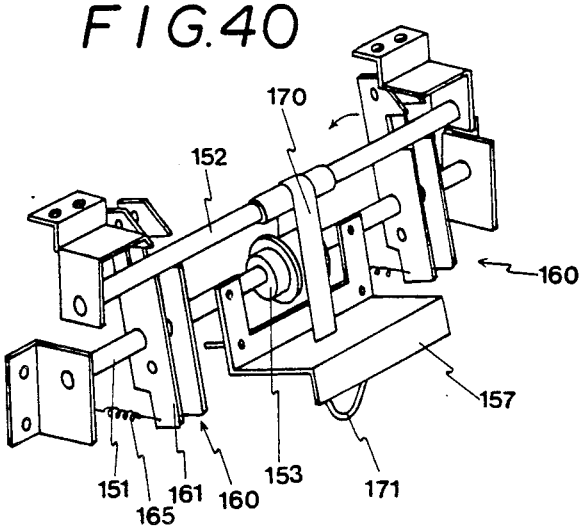

In the operating device 150, on the fixed frame 2 and the wing frame 3, the main shaft 151 and the operation shaft 152 are supported and, by providing the lock member 160 capable of engaging and disengaging with the operation shaft 152 with the main shaft 151, the wing frame 3 is kept in a position of closing. And the device 150 is composed so as to, with the operating member formed by a gas-damper 140 biased to lift the closed wing frame 3 to open from the fixed frame 2, by an operation of the sky light 100 from underside to open the wing frame 3 using the biasing force of the gas-damper 140. In the operation, from the initial closed position shown in FIG. 39, by using an ordinary hooked rod, the lock-releasing member 157 is pushed up as shown in FIG. 40. By this simple operation, as shown in dashed lines in FIG. 37, the lock member 160 is inclined and by initiating the movement of operation shaft 152 by the projection 163 formed on the jaw part of the notch 162, the operation shaft 152 is released from the notch 162 and, the shaft being supported on the wing frame 3, by the biasing force of the gas-damper 140, the wing frame 3 is raised to open the sky light.

Figure 41:
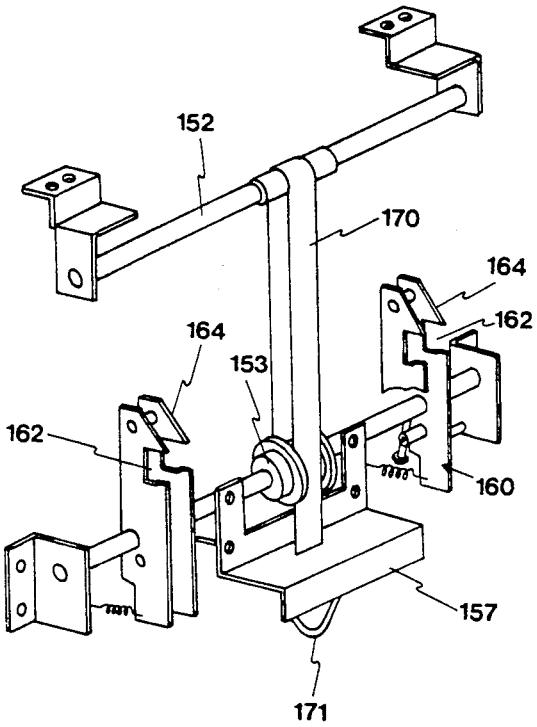

Following this operation, the coil spring 154 in the winding drum 153 of the main shaft 151 is unwound to deliver the operation belt 170 out as shown in FIG. 41. The operation belt 170 is drawn out until the ring member 171 at the free end comes to contact with the guiding rollers 156 to stop the extension and to terminate the opening of the wing frame 3.

Figure 42:
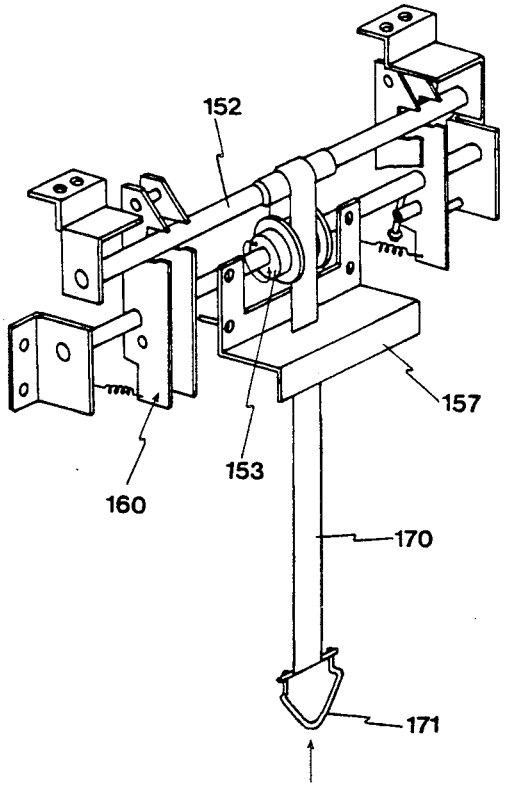

To close the sky light 100, the hook of the manual operating rod is engaged with the ring member 171 and from the state shown in FIG. 41, and by drawing the ring member 171 down, the operation shaft 152 descends until to contact with the sloping edge 164 formed on the lock member 160 and then to be held in the notch 162 to end in the state shown in FIG. 42. Here, as the operation of drawing down by the hooked rod follows the principle of the block (pulley) of the operation belt 170 with one end fixed on the winding drum 153 and wound around the roller 155 on the operation shaft 152, the manual power required on the ring member 171 against the biasing force of the gas-damper 140 is reduced by half. And when the force on the ring member 171 is released, the extended operation belt 170 is wound into the drum 153 by the spring 154 and whole of the operating device 150 reverts to the original position shown in FIG. 39.

As the manual operation requires only a space underside of the operating device 150, except the space the installation of the anti-insect screen is available eliminating its fixing and removal or its opening and closing.

INDUSTRIAL APPLICABILITY

In a sky light comprising a fixed frame and a wing frame connected by connecting members and capable of opening and closing by the operating members, as the sky light according to the present invention is installed with a detecting device for rainfall on the fixed frame, when it rains suddenly while the sky light is open, the detecting device detects rainfall and the wing frame can be operated to close the sky light. And as the detecting device is constructed to have a posture of operations of detecting the weather when the wing fame is open, and a posture to protect the detecting sensor of the detecting device when the wing frame is closed, a good durability of the device for the weather is obtained without deterioration and loss of its sensitivity nor eventual leakage of electricity is offered. While, the sky light having function of getting top light as well as ventilation, various aspects of operation members to open and close the sky light are shown, and various composition of the detecting device are disclosed to adapt rainfall while the sky light is open.

Also, in view of the construction to fix lighting members on the wing frame, the object of the sky light of the present invention lies in elimination of drawbacks of prior art. Moreover, from experiences obtained in the production, constructions of minor parts are improved in various way to contribute to practicality.

It is noted that the sky light according to the present invention, within the scope thereof, various applications and combinations are available following disclosures of embodiments.

We claim:

1. In a movable sky light comprising a fixed frame having an opening therein and a movable wing frame connected to said fixed frame, said fixed frame being equipped with a driving device for opening and closing said wing frame relative to said opening, a detecting device disposed on said fixed frame, the detecting device comprising a rainfall sensor and a sensor protecting means, said sensor protecting means including means for swinging said sensor between a first position where said sensor is positioned outside of the fixed frame where said sensor is exposed to outdoor elements and a second position where said sensor is protected under said wing frame, said sensor protecting means allowing rainfall to contact said sensor when the wing frame is open and inhibiting rainfall from contacting said sensor when the wing frame is close, the sensor then being protected by the sensor protecting means.

2. A movable sky light as defined in claim 1, wherein said fixed frame and said wing frame are connected by pairs of connecting members disposed on opposing sides of the opening and wherein the connecting members provide operating members for opening and closing said wing frame by mechanical cooperation of the driving device with the connecting members.

3. A movable sky light as defined in claim 1, wherein said driving device is operated electrically and the device closes the wing frame in response to an output signal from the detecting device.

4. A movable sky light as defined in claim 2, wherein the operating member comprises a pair of equal operating rods crossed in a form of X at middle portions thereof, said rods acting to raise and lower the wing frame in a parallel orientation to the fixed frame.

5. A movable sky light as defined in claim 2, wherein the length of the operating member comprises rods of differing lengths, said rods acting to raise and lower the wing frame at an angle to the fixed frame.

6. A movable sky light as defined in claim 2, wherein an auxiliary operating member is disposed on a side of said opening between said opposing sides.

7. A movable sky light as defined in claim 1, wherein the fixed frame and the wing frame are connected on one side by a hinge and an operating member is disposed between the fixed frame and the wing frame.

8. A movable sky light as defined in claim 1, wherein the sensor of the detecting device passes a cleaning device disposed no the fixed frame as it is swung between its first and second positions.

9. A movable sky light as defined in claim 1, wherein the detecting device is disposed outwardly of the fixed frame when the wing frame is open and, when the wing frame is closed, the detecting device is covered by a protecting means on the wing frame.

10. A movable sky light as defined in claim 1, wherein the detecting device is disposed projecting outward at an folding point of a inwardly foldable supporter linking the fixed frame and the wing frame and, when the wing frame closes, following the inward folding of the supporter, is contained inside of the fixed frame.

11. A movable sky light as defined in claim 1, wherein the sensor is disposed outside of the fixed frame and the sensor protecting means is disposed on an acting member fixed on the fixed frame for raising and lowering the protecting means.

12. A movable sky light as defined in claim 1, wherein the wing frame includes a sheet of transparent glass, double layer glass, plastics or any combination thereof.

13. A movable sky light as defined in claim 1, wherein the wing frame includes an anti-moisture glass made of double layer glass.

14. A movable sky light as defined in claim 1, wherein said wing frame includes a glass member, the outer edges of which are supported on a stepped seat formed on inner edges of sides of the wing frame and wherein the glass member is fixed by an adhesive strip capable of sticking on both sides on a top surface of the stepped seat.

15. A movable sky light as defined in claim 14, wherein the glass member is an anti-moisture glass of double layer having an inner layer of glass smaller than an outer layer of glass so as to provide an extra stepped zone at the outer layer of glass and wherein sealing parts around the inner layer of glass are disposed apart from supporting edges of the outer layer of glass on the stepped seat of the wing frame.

16. A movable sky light as defined in claim 1, wherein the wing frame has a plastic sheet disposed therein, the sheet being supported on the wing frame by an adhesive strip capable of sticking on both sides on a top surface of the wing frame.

17. A movable sky light as defined in claim 7, wherein at ends of the hinge, guide pieces are provided for the wing frame to fill up gaps formed between the inner side of the wing frame.

18. A movable sky light as defined in claim 2, wherein the operating member is biased to open the wing frame and wherein a manual operating device for opening the wing frame is provided.

19. A movable sky light as defined in claim 7, wherein the operating member is biased to open the wing frame and wherein a manual operating device for opening the wing frame is provided.

20. A movable sky light as defined in claim 18, wherein the manual operating device comprises a main shaft supported on the fixed frame, an operating shaft supported on the wing frame, a lock member fixed on the main shaft for engaging the operating shaft when the wing frame is closed and for releasing the operating shaft in response to manual operation of said lock member, and an operating belt wound around the main shaft and the operating shaft, one end of the operating belt being fixed on a winding drum with a biasing force in a winding direction and the other end of the operating belt having a ring member.

21. A movable sky light as defined in claim 19, wherein the manual operating device comprises a main shaft supported on the fixed frame, an operating shaft supported on the wing frame, a lock member fixed on the main shaft for engaging the operating shaft when the wing frame is closed and for releasing the operating shaft in response to manual operation of said lock member, and an operating belt wound around the main shaft and the operating shaft, one end of the operating belt being fixed on a winding drum with a biasing force in a winding direction and the other end of the operating belt having a ring member.

22. A movable sky light as defined in claim 20, further including a screen installed in said opening.

23. A movable sky light as defined in claim 12, further including a wired glass plate is installed in said wing frame under said sheet.

24. A sky light comprising:

(a) a fixed frame having an opening therein;

(b) a movable frame operationally disposed relative to said fixed frame for selectively opening and closing the opening therein;

(c) driving means for moving said movable frame between an open position wherein said opening is open and a closed position wherein said movable frame covers said opening;

(d) a rain sensor; and (e) sensor protecting means responsive to said driving means for covering said rain sensor in response to the closing of said movable frame said sensor protecting means including means for moving said rain sensor between a first position where said rain detector is positioned outside of said movable frame when said movable frame is in its open position and a second position wherein said rain sensor is positioned such that it is covered by said movable frame when said movable frame is in its closed position.

25. The sky light of claim 24, wherein said rain sensor moves relative to said fixed frame.

26. The sky light of claim 25 wherein said driving means includes pairs of connecting members, a pair being installed on opposite sides of said opening, at least one of said connecting members being driven by a motor, and wherein said means for moving said rain sensor includes means operatively connected to said motor, wherein said motor is effective for opening and closing said movable frame and also for moving said rain sensor between its first and second positions.

* * * * *